US008614044B2

(12) United States Patent
Matsui et al.

(10) Patent No.: US 8,614,044 B2
(45) Date of Patent: Dec. 24, 2013

(54) TONER

(75) Inventors: Takashi Matsui, Suntou-gun (JP); Michihisa Magome, Mishima (JP); Yusuke Hasegawa, Suntou-gun (JP); Tomohisa Sano, Mishima (JP); Shuichi Hiroko, Susono (JP); Yoshitaka Suzumura, Mishima (JP); Shotaro Nomura, Suntou-gun (JP); Atsuhiko Ohmori, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 132 days.

(21) Appl. No.: 13/159,172

(22) Filed: Jun. 13, 2011

(65) Prior Publication Data

US 2011/0311910 A1 Dec. 22, 2011

(30) Foreign Application Priority Data

Jun. 16, 2010 (JP) ..... 2010-137022

(51) Int. Cl.
*G03G 9/00* (2006.01)

(52) U.S. Cl.
USPC ..... 430/111.4; 430/108.4; 430/108.8; 430/137.15

(58) Field of Classification Search
USPC ..... 430/108.4, 111.4, 108.8, 137.15
See application file for complete search history.

(56) References Cited

U.S. PATENT DOCUMENTS

| | | | | |
|---|---|---|---|---|
| 5,536,612 | A * | 7/1996 | Yamaguchi et al. | 430/137.12 |
| 5,948,582 | A | 9/1999 | Nakamura et al. | |
| 6,051,350 | A | 4/2000 | Inaba et al. | |
| 6,077,635 | A | 6/2000 | Okado et al. | |
| 6,077,636 | A | 6/2000 | Moriki et al. | |
| 6,183,927 | B1 | 2/2001 | Magome et al. | |
| 6,287,739 | B1 | 9/2001 | Kawakami et al. | |
| 6,447,969 | B1 | 9/2002 | Ito et al. | |
| 6,465,144 | B1 | 10/2002 | Hashimoto et al. | |
| 6,544,708 | B2 | 4/2003 | Komoto et al. | |
| 6,586,151 | B1 | 7/2003 | Naka et al. | |
| 6,596,452 | B2 | 7/2003 | Magome et al. | |
| 6,638,674 | B2 | 10/2003 | Komoto et al. | |
| 6,653,035 | B2 | 11/2003 | Komoto et al. | |
| 6,703,176 | B2 | 3/2004 | Naka et al. | |
| 6,803,164 | B2 | 10/2004 | Mizoo et al. | |
| 6,953,646 | B2 | 10/2005 | Doujo et al. | |
| 7,043,175 | B2 | 5/2006 | Komoto et al. | |
| 7,123,862 | B2 | 10/2006 | Hasegawa et al. | |
| 7,160,660 | B2 | 1/2007 | Dojo et al. | |
| 7,361,442 | B2 | 4/2008 | Otake et al. | |
| 7,368,211 | B2 | 5/2008 | Hasegawa et al. | |
| 7,371,494 | B2 | 5/2008 | Chiba et al. | |
| 7,452,649 | B2 | 11/2008 | Magome et al. | |
| 7,470,494 | B2 | 12/2008 | Nishiyama et al. | |
| 7,560,212 | B2 | 7/2009 | Chiba et al. | |
| 7,582,401 | B2 | 9/2009 | Ogawa et al. | |
| 7,678,523 | B2 | 3/2010 | Hiroko et al. | |
| 7,678,524 | B2 | 3/2010 | Hasegawa et al. | |
| 7,704,659 | B2 | 4/2010 | Ogawa et al. | |
| 7,811,734 | B2 | 10/2010 | Ogawa et al. | |
| 7,842,446 | B2 | 11/2010 | Yanase et al. | |
| 7,906,266 | B2 | 3/2011 | Magome et al. | |
| 7,923,190 | B2 | 4/2011 | Magome et al. | |
| 7,935,467 | B2 | 5/2011 | Dojo et al. | |
| 7,939,231 | B2 | 5/2011 | Ogawa et al. | |
| 8,084,174 | B2 | 12/2011 | Hasegawa et al. | |
| 8,124,306 | B2 | 2/2012 | Hirata et al. | |
| 2005/0186497 | A1 * | 8/2005 | Moribe et al. | 430/109.3 |
| 2007/0072102 | A1 | 3/2007 | Dojo et al. | |
| 2007/0099102 | A1 * | 5/2007 | Ieda | 430/108.1 |
| 2009/0047043 | A1 | 2/2009 | Dojo et al. | |
| 2009/0117477 | A1 | 5/2009 | Magome et al. | |
| 2009/0197192 | A1 | 8/2009 | Hiroko et al. | |
| 2010/0266943 | A1 | 10/2010 | Sano et al. | |
| 2011/0294056 | A1 | 12/2011 | Magome et al. | |
| 2011/0311910 | A1 | 12/2011 | Matsui et al. | |
| 2012/0045717 | A1 | 2/2012 | Hiroko et al. | |
| 2012/0094226 | A1 | 4/2012 | Tani et al. | |

FOREIGN PATENT DOCUMENTS

| | | | |
|---|---|---|---|
| JP | 11-160909 | A | 6/1999 |
| JP | 2003-280270 | A | 10/2003 |
| JP | 2006-343372 | A | 12/2006 |

* cited by examiner

*Primary Examiner* — Thorl Chea
(74) *Attorney, Agent, or Firm* — Fitzpatrick, Cella, Harper and Scinto

(57) ABSTRACT

To provide a toner which can achieve both low-temperature fixing performance and dot reproducibility and further can obtain images on which any density non-uniformity has been kept from coming about, the toner has toner particles, each of the toner particles has a toner base particle containing a binder resin, a colorant and a release agent, and an inorganic fine powder; the toner having:

(1) an average circularity of 0.960 or more;

(2) a number-average molecular weight Mn(25° C.) of from 500 or more to 3,000 or less in measuring a tetrahydrofuran-soluble matter at 25° C. of the toner by SEC-MALLS; and (3) a value of Mn(135° C.)/Mn(25° C.) of from 25 or more to 50 or less which is the ratio of number-average molecular weight Mn(135° C.) in measuring an o-dichlorobenzene-soluble matter at 135° C. of the toner by SEC-MALLS to number-average molecular weight Mn(25° C.) in measuring a tetrahydrofuran-soluble matter at 25° C. of the toner by SEC-MALLS.

7 Claims, 2 Drawing Sheets

TONER

BACKGROUND OF THE INVENTION

1. Field of the Invention

The present invention relates to a toner used in electrophotography, electrostatic recording, magnetic recording and the like.

2. Description of the Related Art

A number of methods are conventionally known as methods for electrophotography. In general, copies or prints are obtained by forming an electrostatic latent image on an electrostatic latent image bearing member (hereinafter also termed "photosensitive member") by utilizing a photoconductive material and by various means, subsequently developing the latent image by the use of a toner to form a toner image as a visible image, transferring the toner image to a recording medium such as paper as occasion calls, and thereafter fixing the toner image onto the recording medium by the action of heat and/or pressure. Apparatus for such image formation include copying machines, printers and so forth.

These printers or copying machines are being changed over from analogue machines to digital machines, and it is strongly sought to have a good reproducibility of latent images and a high resolution and at the same time to achieve higher image quality and energy saving.

Various approaches are taken to the achievement of higher image quality. In particular, making dot reproducibility higher and making any density non-uniformity not come about at the time of fixing are given as important items. Meanwhile, about a recording medium paper, the paper is becoming rich in variety, including wood free paper, which is small in any surface unevenness (hills and dales) coming from fibers, and what is called antique paper (paper with rough surface), which is large in such surface unevenness.

Here think about the density non-uniformity at the time of fixing. Density non-uniformity due to a difference in density or gloss tends to come about in the case of the antique paper, which is large in the surface unevenness coming from fibers. This is because, at hills (areas of surface that are higher than the areas around them) of paper surface that come from fibers, heat and pressure are readily applied to the toner that is present there at the time of fixing and hence the toner is sufficiently pressed and spread thereon to become fixable to the paper. If, however, the heat and pressure are applied thereto in excess, the toner may so much soak into fibers of the paper as to result in low gloss or density. Such a phenomenon may be seen. On the other hand, at dales (areas of surface that are lower than the areas around them) of paper surface that come from fibers, sufficient heat and pressure can not readily be applied to the toner, and hence the toner tends to be insufficiently melted there to tend to result in low density or gloss.

Moreover, where any fixing assembly of printers or copying machines is made simple or fixing temperature is set lower for the purpose of energy saving, the specific heat a sheet of paper has at its leading end area and rear end area from the fixing assembly tends to greatly differ between them, and hence the density non-uniformity more tend to come about. Also, the density non-uniformity may remarkably come about in halftone images, having a small toner laid-on level on the paper.

More specifically, in order to make any density non-uniformity not easily come about at the time of fixing, it is a subject for the toner to have a uniform fixing performance over broad pressure and temperature ranges.

For this subject, various improvements have been attempted in terms of toners. In Japanese Patent Application Laid-open No. 2003-280270, a toner is proposed which is a toner containing at least a binder resin and a colorant, wherein the binder resin component is a polyester resin, contains from 5% by mass or more to 30% by mass or less of THF-soluble matter, and also has a peak (P1) in the elution volume range of absolute molecular weight of from $3.0\times10^3$ or more to $3.0\times10^4$ or less, a peak (P2) in the elution volume range of absolute molecular weight of from $5.0\times10^4$ or more to $6.0\times10^5$ or less and a peak (P3) in the elution volume range of absolute molecular weight of from $2.0\times10^6$ or more to $5.0\times10^7$ or less, each in the relationship between elution volume and light scattering intensity which are obtained by a light scattering detector in GPC-MALLS analysis of the THF-soluble matter.

In Japanese Patent Application Laid-open No. H11-160909, also proposed are a process for producing a polymerization toner which process comprises the step of subjecting a polymerizable monomer composition to suspension polymerization in the presence of an oil-soluble polymerization initiator until polymerization conversion comes to be within the range of from 30% or more to 97% or less, and the step of adding a water-soluble polymerization initiator into an aqueous dispersion medium while the polymerization conversion is within the above range, to further continue the suspension polymerization to form colored polymer particles, and also a process for producing a polymerization polymer of core/shell structure which process comprises the step of further subjecting a polymerizable monomer for shells to suspension polymerization in the presence of the colored polymer particles to form colored polymer particles on the surfaces of which polymer layers serving as shells have been formed.

In Japanese Patent Application Laid-open No. 2006-343372, also proposed is a process for producing a toner by polymerizing in an aqueous medium a polymerizable monomer composition containing at least a polymerizable monomer and a colorant, wherein a peroxydicarbonate compound is used as a polymerization initiator.

In all these toners, their low-temperature fixing performance, developing performance and storage stability are improved. However, there has still been room for further improvement in respect of their low-temperature fixing performance and dot reproducibility. Further, the effect against the density non-uniformity has been insufficient, and there has been room for improvement.

SUMMARY OF THE INVENTION

The present invention has been made taking account of the problems the prior art has had, and a subject thereof is to provide a toner which can achieve both the low-temperature fixing performance and the dot reproducibility and further can obtain images on which any density non-uniformity has been kept from coming about.

The present invention is a toner comprising toner particles, each of the toner particles comprises a toner base particle containing a binder resin, a colorant and a release agent, and an inorganic fine powder;

the toner having:

(1) an average circularity of 0.960 or more;

(2) a number-average molecular weight Mn(25° C.) of from 500 or more to 3,000 or less in measuring a tetrahydrofuran-soluble matter at 25° C. of the toner by size extrusion chromatography with multi-angle laser light scattering photometry (SEC-MALLS); and (3) a value of Mn(135° C.)/Mn(25° C.) of from 25 or more to 50 or less which is the ratio of number-average molecular weight Mn(135° C.) in measuring an o-dichlorobenzene-soluble matter at 135° C. of the toner by size extrusion chromatography with multi-angle laser light scattering photometry (SEC-MALLS) to number-average molecular weight Mn(25° C.) in measuring a tetrahydrofuran-soluble matter at 25° C. of the toner by size extrusion chromatography with multi-angle laser light scattering photometry (SEC-MALLS).

According to the present invention, the toner can be provided which can achieve both the low-temperature fixing performance and the dot reproducibility and further can obtain images on which any density non-uniformity has been kept from coming about.

Further features of the present invention will become apparent from the following description of exemplary embodiments with reference to the attached drawings.

DESCRIPTION OF THE EMBODIMENTS

Figure 1:
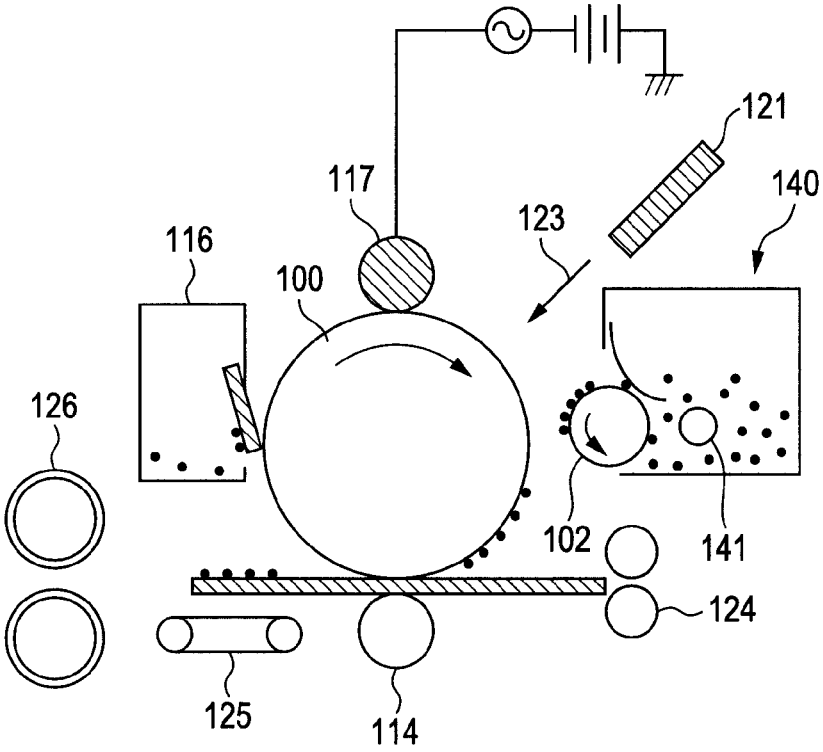
FIG. 1 is a schematic view showing an image forming apparatus used in Examples of the present invention.

Preferred embodiments of the present invention will now be described in detail in accordance with the accompanying drawings.

The present invention is concerned with a toner.

In regard to an image forming method and a fixing method, any conventional electrophotographic process is applicable, and there are no particular limitations thereon.

Think about how the toner behaves at the time of fixing. Toner images formed on a sheet of paper in an unfixed state are first heated by heat of a fixing assembly, and then plasticized and melted on. Further, the paper with toner images is heated and pressured when it is passed through a fixing nip zone of the fixing assembly, and this makes the toner fixed on to the paper while being plasticized, melted and deformed. Thereafter, the toner comes apart from fixing members and is fixed onto the paper. If it is insufficiently fixed, the toner may come off the paper surface, and the toner may stick to a fixing roller or fixing film. This may cause what is called offset.

Think in detail about the fixing of toner to paper. At hills of paper surface that come from paper fibers, the heat and pressure are readily applied to the toner that is present there at the time of fixing and hence the toner is sufficiently pressed and spread thereon to become fixable to the paper. If, however, the heat and pressure are applied thereto in excess, the toner may so much soak into fibers of the paper as to result in low gloss or density. Such a phenomenon may be seen.

On the other hand, at dales of paper surface that come from paper fibers, any sufficient heat and pressure can not readily be applied to the toner, and hence the toner tends to be insufficiently melted there to tend to result in low gloss.

The paper is also heated by the fixing assembly at the time of fixing, and hence, although the fixing assembly is heated by a heat source at any time, there is a tendency that the amount of heat conducted to the toner becomes lower at a rear end area of a sheet (paper) than at a leading end area thereof.

Thus, the sheet is most readily heated and pressured at the hills in its leading end area, and the sheet is most not readily heated and pressured at the dales in its rear end area. Such a difference in fixing performance may come to cause density non-uniformity.

The present inventors have made studies in order to obtain images showing the like fixing performance at the above two areas and on which any density non-uniformity has been kept from coming about.

First, taking account of the fact that the sheet is most not readily heated and pressured at the dales in its rear end area, a polymerization initiator used commonly was used in a large quantity to make the toner have a low molecular weight in order for the toner particles to be deformable under small amount of heat and/or pressure, and further a release agent was added in a large quantity in order to accelerate plasticization. Next, taking account of the fact that the heat and pressured are most applied to the sheet at the hills in its leading end area, the binder resin for toner was made to have gel matter (tetrahydrofuran-insoluble matter measured by Soxhlet extraction) using a cross-linking agent as a commonly available method, in order for the toner particles to be kept from being deformed in excess. That is, a toner was produced which was made to have the gel matter and moreover the binder resin of which was made to have a low molecular weight and further to which the release agent was added in a large quantity.

As the result, about the density non-uniformity between the hills and dales of paper surface that come from paper fibers and also between the leading end area and rear end area of the sheet, there was a tendency for them to be remedied, but there still remained the difference in density and difference in gloss between the hills in the leading end area of the sheet and the dales in the rear end area of the sheet at which the density non-uniformity most tended to come about.

This was considered to come from the fact that, although it was so attempted that the toner was well fixable at the hills in the leading end area of the sheet and was kept by the gel matter from being fixed in excess, it was not completely kept from being fixed in excess probably because of poor balance between the molecular weight made lower and the gel matter. This was also considered to be caused by the fact that, at the dales in the rear end area of the sheet, it was urged for the toner particles to be deformable under small amount of heat and/or pressure by making the toner have a low molecular weight and adding the release agent in a large quantity, but this was so insufficient or so poorly balanced with the gel matter as to cancel the lowering of molecular weight and the effect attributable to the release agent, unwantedly. In addition, such a toner tended to cause faulty charging during its long-term service, and hence a problem was also seen such that the toner lowered in dot reproducibility after images were formed on many sheets. Another problem was also seen such that the fixing film was stained when a toner which was seen to have much caused density non-uniformity was used over a long period of time.

The present inventors have further continued their studies. As the result, they have reached a finding that the density non-uniformity can dramatically be kept from coming about by making the toner satisfy a specific molecular weight distribution, and have accomplished the present invention. The molecular weight distribution herein referred to is, e.g., not any molecular weight distribution of a component separated by extracting the toner with tetrahydrofuran (THF) at normal temperature, which is commonly used. More specifically, it is the relationship between number-average molecular weight Mn(25° C.) of a component separated by extracting the toner with tetrahydrofuran (THF) at 25° C. and number-average molecular weight Mn(135° C.) of a component separated by extracting the toner with o-dichlorobenzene (ODCB) at 135° C.

That is, many studies have hitherto been made on the molecular weight distribution of any component extracted with THF at normal temperature as conventionally done and the presence or absence of any THF-insoluble matter (what is called gel matter). This, however, has been insufficient, and it has been important to take account of, in addition to such a normal temperature THH-extracted component, the molecular weight distribution and molecular structure of any component other than the normal temperature THH-extracted component. As an index of such an additional component, the Mn(135° C.) may be used.

That is, by Mn(135° C.) operation, any high-molecular weight component, branched structural component and so forth which are not extractable with THF by Mn(25° C.) operation are extracted, and hence molecules of such a high-molecular weight component or branched structural component are also taken into account.

More specifically, among conventional THF-insoluble matter (what is called gel matter), there have been what is extractable with o-dichlorobenzene (ODCB) and what is not extractable therewith, and it has been necessary to take account of such components. Here, whether or not any component is extractable with o-dichlorobenzene (ODCB) depends on the molecular weight or branched structure of the high-molecular weight component.

For example, among such high-molecular weight components as those not extractable with THF, one having a relatively small molecular weight and one having a high solubility in ODCB as having less branched structure are made to be extracted.

Here, in the Mn(135° C.) operation, o-dichlorobenzene (ODCB) is used as an extraction solvent. The reasons therefor are that the o-dichlorobenzene (ODCB) has a boiling point of as high as 180° C., and hence it is feasible for the extraction at such a high temperature of 135° C., and further that it is a polar solvent, and hence it has a high extraction ability.

In addition, in the present invention, the molecular weight is measured not by conventional GPC but by SEC-MALLS. The reason therefor is that correct molecular weight (absolute molecular weight) can be measured in all forms of linear polymers or branched polymers. For example, the molecular weight calculated by GPC is commonly the molecular weight converted in terms of polystyrene, and is put to molecular sieving according to molecular sizes when any component passes through a column(s). Hence, without regard to linear polymers or branched polymers, components are recognized as those having the like molecular weight as long as they are equal to each other in molecular size. On the other hand, in the SEC-MALLS, either a linear polymer or a branched polymer, even though having the like molecular size, can be distinguished by multi-angle laser light scattering photometry, and hence the linear polymer and the branched polymer are measured as those each having different molecular weight.

In the present invention, it is aimed for the toner to be improved in fixing performance against any density non-uniformity or the like, and what are important are the readiness of melting of the toner and the extent of deformation of toner particles in the molten state. Hence, what is to be measured is insufficient if it is the molecular weight found by GPC, as stated previously, and the molecular weight (number-average molecular weight) found by SEC-MALLS is taken as an index that indicates the readiness of melting of the toner and the prevention of any excess deformation of toner particles in the molten state.

In the present invention, the "number-average" molecular weight is also specified because, in discussion about the melting of toner that is concerned with the fixing performance against the density non-uniformity, the number of molecules of any low-molecular weight component among toner constituent components has a great influence.

Studies made by the present inventors have revealed that it is important as the binder resin to satisfy the following conditions.

(1) That the number-average molecular weight Mn(25° C.) is from 500 or more to 3,000 or less in measuring a tetrahydrofuran-soluble matter at 25° C. of the toner by size extrusion chromatography with multi-angle laser light scattering photometry (SEC-MALLS).

(2) That the value of Mn(135° C.)/Mn(25° C.) is from 25 or more to 50 or less which is the ratio of number-average molecular weight Mn(135° C.) in measuring an o-dichlorobenzene-soluble matter at 135° C. of the toner by size extrusion chromatography with multi-angle laser light scattering photometry (SEC-MALLS) to number-average molecular weight Mn(25° C.) in measuring a tetrahydrofuran-soluble matter at 25° C. of the toner by size extrusion chromatography with multi-angle laser light scattering photometry (SEC-MALLS).

First, inasmuch as the number-average molecular weight Mn(25° C.) is not more than 3,000 in measuring a tetrahydrofuran-soluble matter at 25° C. of the toner by size extrusion chromatography with multi-angle laser light scattering photometry (SEC-MALLS), the toner is improved in its melting and plasticity, and hence the deformation of toner particles is accelerated, where, e.g., the toner is improved in low-temperature fixing performance even at the dales in the rear end area of the sheet. If the number-average molecular weight Mn(25° C.) is more than 3,000, the toner tends to be insufficient for its melting and plasticity, e.g., at the dales in the rear end area of the sheet, resulting in low density and gloss to cause density non-uniformity.

Then, inasmuch as the number-average molecular weight Mn(25° C.) is not less than 500, the toner particles can easily be kept from being deformed in excess, and hence the toner is improved in low-temperature fixing performance and besides can have a high charging stability during its long-term service, making it easy for the toner to be improved in dot reproducibility. Further, the toner is also improved in storage stability. If the number-average molecular weight Mn(25° C.) is smaller than 500, the toner particles tend to be deformed in excess, e.g., at the hills in the leading end area of the sheet to tend to result in a low density. Also, a low-molecular weight component such as an oligomer may increase, and hence the toner tends to cause faulty charging during its long-term service, where a problem may also be seen such that its dot reproducibility lowers in the latter half of running.

Thus, the number-average molecular weight Mn(25° C.) is from 500 or more to 3,000 or less in measuring a tetrahydrofuran-soluble matter at 25° C. of the toner by size extrusion chromatography with multi-angle laser light scattering photometry (SEC-MALLS). The number-average molecular weight Mn(25° C.) may preferably be from 1,000 or more to 2,500 or less.

It is also necessary that the value of Mn(135° C.)/Mn(25° C.) is from 25 or more to 50 or less which is the ratio of number-average molecular weight Mn(135° C.) in measuring an o-dichlorobenzene-soluble matter at 135° C. of the toner by size extrusion chromatography with multi-angle laser light scattering photometry (SEC-MALLS) to number-average molecular weight Mn(25° C.) in measuring a tetrahydrofuran-soluble matter at 25° C. of the toner by size extrusion chromatography with multi-angle laser light scattering photometry (SEC-MALLS).

That the value of Mn(135° C.)/Mn(25° C.) is from 25 or more to 50 or less namely represents that the Mn(135° C.) is sufficiently larger than the Mn(25° C.), showing that the molecular weight distribution is broad. Hence, the toner can be plasticized and melted in broad pressure and temperature ranges when it is fixed, promising a broad fixing range. This enables any density difference and gloss difference to be kept from coming, e.g., at the hills in the leading end area of the sheet and the dales in the rear end area of the sheet at which the density non-uniformity most tended to come about.

In contrast thereto, that the value of Mn(135° C.)/Mn(25° C.) is smaller than 25 namely means that the change of the Mn(25° C.) and Mn(135° C.) is in a low level. For example, if the value of Mn(135° C.) has come small, the toner tends to be fixed in excess when fixed at such high temperature and pressure as those at the hills in the leading end area of the sheet, and may result in low density and gloss. If on the other hand the value of Mn(25° C.) has come large, the toner tends to be insufficiently plasticized and melted, and tends to result in low density and gloss.

That the value of Mn(135° C.)/Mn(25° C.) is larger than 50 means that the change of the Mn(25° C.) and Mn(135° C.) is in a high level. If the Mn(135° C.) is excessively larger with respect to the Mn(25° C.), the toner may come into a state which is close to a conventional toner having any gel matter and made to have a low molecular weight, and hence the toner tends to be insufficiently plasticized and melted at a portion where the temperature and pressure are most not easily applied to the toner, e.g., at the dales in the rear end area of the sheet. If on the other hand the Mn(25° C.) is small, the toner has its low-molecular weight component in a large quantity, and hence tends to come to soak into paper fibers in excess to tend to result in low density and gloss.

Thus, inasmuch as the Mn(25° C.) and the value of Mn(135° C.)/Mn(25° C.) fall within the ranges of the present invention, the toner can balance its low-molecular weight component with its high-molecular weight component, and can dramatically remedy the density non-uniformity.

In order for the respective values to be so made as to satisfy the ranges specified in the present invention, this may be achieved, as described later, by controlling points such as the type of a polymerization initiator and timing for its addition, the conditions for polymerization reaction, the type of a cross-linking agent, whether any metal cross-linking be effected, and so forth to control the structure of the binder resin.

Then, the number-average molecular weight Mn(135° C.) in measuring an o-dichlorobenzene-soluble matter at 135° C. of the toner by size extrusion chromatography with multi-angle laser light scattering photometry (SEC-MALLS) may preferably be from 15,000 or more to 150,000 or less. Inasmuch as the Mn(135° C.) is not less than 15,000, the toner can easily be kept from soaking into paper fibers in excess even at a portion where the temperature and pressure are most easily applied to the toner, e.g., at the hills in the leading end area of the sheet, making it easy to obtain images having good density and gloss. Also, inasmuch as the Mn(135° C.) is not more than 150,000, this is preferable because the toner can easily be plasticized and melted even at a portion where the temperature and pressure are most not easily applied to the toner, e.g., at the dales in the rear end area of the sheet.

The toner of the present invention may preferably have a tetrahydrofuran-soluble matter at 25° C. in the binder resin, in an amount of from 50% by mass or more to 90% by mass or less. Inasmuch as it is in an amount of from 50% by mass or more to 90% by mass or less, the toner can easily be improved in low-temperature fixing performance.

The toner of the present invention may also preferably have an o-dichlorobenzene-insoluble matter Go (%) at 135° C. in the binder resin, in an amount of 30% by mass or less. Inasmuch as it is in an amount of 30% by mass or less, the density non-uniformity can easily be kept from coming about.

The component insoluble in tetrahydrofuran at 25° C. and soluble in o-dichlorobenzene at 135° C. is a high-molecular weight component or the like having relatively low molecular weight and less containing any cross-linked component or branches, and hence it enables the toner to be easily kept from soaking into paper fibers in excess without inhibiting its low-temperature fixing performance. Such a component insoluble in tetrahydrofuran at 25° C. and soluble in o-dichlorobenzene at 135° C. may preferably be in an amount of from 10% by mass or more to 50% by mass or less.

Here, to measure the tetrahydrofuran-soluble matter at 25° C., first, about 0.5 g of the toner is weighed (W1 g), which is then put into a sample bottle. Into it, 200 ml of tetrahydrofuran (THF) is introduced to carry out extraction for 24 hours in an atmosphere of 25° C.

After the extraction has been completed, the extract obtained is put into a cylindrical filter paper (e.g., trade name: No. 86R, 28 mm×100 mm in size, available from Advantec Toyo, Co., Ltd.) weighed previously, to make filtration. Thereafter, this is washed twice with THF and then air-dried, and thereafter vacuum-dried at 40° C. for 8 hours, where the mass of the cylindrical filter paper containing extraction residues is measured, and the mass (W2 g) of the extraction residues is calculated by subtracting the mass of the cylindrical filter paper.

Next, the content (W3 g) of components other than the resin component is determined by the following procedure. About 2 g of the toner is weighed (Wa g) and put into a 30 ml magnetic crucible weighed previously. This crucible is put into an electric furnace, and is heated at about 900° C. for about 3 hours, followed by leaving to cool in the electric furnace, and then leaving to cool in a desiccator for 1 hour or more at normal temperature, where the mass of the crucible containing incineration residue ash content is weighed, and the incineration residue ash content (Wb g) is calculated by subtracting the mass of the crucible. Then, the incineration residue ash content (W3 g) in W1 g of the sample is calculated according to the following expression (1).

$$W3 = W1 \times (Wb/Wa) \quad (1).$$

In this case, the value of the tetrahydrofuran-soluble matter at 25° C. is found according to the following expression (2).

$$\text{Tetrahydrofuran-soluble matter at 25° C. (\% by mass)} = \{1-(W2-W3)/(W1-W3)\} \times 100 \quad (2).$$

Then, the toner of the present invention may preferably have a weight-average molecular weight Mw(25° C.) of from 5,000 or more to 100,000 or less, and much preferably from 5,000 or more to 25,000 or less, in measuring a tetrahydrofuran-soluble matter at 25° C. of the toner by size extrusion chromatography with multi-angle laser light scattering photometry (SEC-MALLS). It may also preferably have a value of Rw(25° C.)/Mw(25° C.) of from $5.0\times10^{-4}$ or more to $1.0\times10^{-2}$ or less which is the ratio of square radius of inertia Rw(25° C.) to weight-average molecular weight Mw(25° C.).

That the weight-average molecular weight Mw(25° C.) is not more than 100,000 is namely that the toner is a low-molecular weight product, and hence it can easily be improved in its low-temperature fixing performance. Also, inasmuch as its weight-average molecular weight Mw(25° C.) is not less than 5,000, the toner particles can easily be kept from being deformed in excess at the time of fixing. Also, the elasticity of toner is kept when the toner is electrostatically charged, and hence the toner can readily be uniformly electrostatically charged. Still also, such a toner enables image density and image quality to be retained during its long-term service.

Then, inasmuch as the toner has the value of Rw(25° C.)/Mw(25° C.) of from $5.0\times10^{-4}$ or more to $1.0\times10^{-2}$ or less which is the ratio of square radius of inertia Rw(25° C.) to weight-average molecular weight Mw(25° C.), it can have a molecular structure preferable for the present invention, and hence it can easily be improved in fixing performance and in image quality during its long-term service.

The ratio Rw(25° C.)/Mw(25° C.) may be controlled by selecting the type of a polymerization initiator, the conditions for polymerization reaction, the type of a cross-linking agent, any effect of metal cross-linking, and so forth. For example, where a straight-chain type molecular structure is to be made up, the ratio may be controlled, e.g., by selecting a polymerization initiator which may readily have like radical species to be formed by the polymerization initiator, by additionally adding another polymerization initiator at the latter stage of reaction, at which any side reaction tends to take place, or by controlling the cross-linking agent.

The square radius of inertia Rw(25° C.) may also preferably be 20 or more to 70 or less. Inasmuch as it is or more to 70 or less, the molecular structure can readily be controlled.

The size extrusion chromatography with multi-angle laser light scattering photometry (SEC-MALLS) is described below.

Presence level for each molecular size is determined in the measurement by SEC (conventional GPC). In contrast thereto, in the SEC-MALLS (making use of an instrument in which an SEC equipment as a separation means is combined with a multi-angle laser light scattering detector), light scattering is utilized, whereby the distribution of molecular weight which is more approximate to the exact molecular weight that reflects differences in molecular structure such as branching or cross-linking can be determined for a mixed sample composed of molecules having the like molecular size. The inertial root mean square which shows the size of a molecule can be also determined.

This enables precise molecular designing of the toner.

In conventional SEC, when the molecules to be measured pass through a column, they undergo the effect of molecular sieving and come eluted in the order of those having a larger molecular size, where the molecular weight is measured. In this case, as to a linear polymer and a branched polymer which have equal molecular weight, the former has a larger molecular size in a solution, and hence it follows that the former comes eluted earlier than the latter. Accordingly, the molecular weight of a branched polymer that is measured by the SEC is measured to be smaller in size than the molecular weight measured by the SEC-MALLS.

Meanwhile, in a light scattering method in the present invention, Rayleigh scattering of molecules to be measured is utilized.

The absolute molecular weight may be determined in all the molecular forms of the linear polymer and branched polymer, by measuring the dependence of an angle of incidence of light that influences the intensity of scattered light on the concentration of a sample, and making analysis by the Zimm method (Zimm plot measurement) or Berry method. In the present invention, the intensity of light scattering light is measured by SEC-MALLS measuring method, and the relationship represented by the following Zimm equation is analyzed by utilizing Debye Plot and weight average molecular weight MW and inertial root mean square R based on absolute molecular weight are calculated. The calculation method from Zimm equation is as follows. The Debye Plot is a graph plotted as vertical axis is K·C/R(θ) and horizontal axis is $\sin^2(\theta/2)$, and the weight average molecular weight MW can be determined from the ordinate intercept and the inertial root means square R can be calculated from the slope. However, the weight average molecular weight Mw of each component fractionized by a column is calculated. In order to calculate number average molecular weight Mn and weight average molecular weight Mw of the sample in total, molecular distribution is clarified by using weight average molecular weight obtained and based on the molecular distribution Mn and Mw need to be calculated again. The same reasons are applied to the determination of the inertial root mean square, Rw of the sample in total needs to be calculated by carrying out statistical processing by employing the inertial root mean square R of each component fractionated by a column.

In the case of measuring by means of the apparatus mentioned below, the number average molecular weight (Mn), weight average molecular weight (Mw) and inertial root mean square (Rw) are obtained by output data from the apparatus.

Zimm equation $$\frac{K\cdot C}{R(\theta)} = \frac{1}{Mw}\cdot\frac{1}{P(\theta)} = \frac{1}{Mw}\cdot\frac{1}{\left\{1-\frac{R\left[\sin^2\left(\frac{\theta}{2}\right)\left(\frac{4\pi}{\lambda}\right)^2\right]}{3}\right\}} = \frac{1}{Mw}\cdot\frac{1}{1-R\sin^2\left(\frac{\theta}{2}\right)\cdot K'} = \frac{1}{Mw}\cdot\frac{1+R\sin^2\left(\frac{\theta}{2}\right)\cdot K'}{\left[1-R\sin^2\left(\frac{\theta}{2}\right)\cdot K'\right]\left[1+R\sin^2\left(\frac{\theta}{2}\right)\cdot K'\right]} = \frac{1}{Mw}\cdot\frac{1+R\sin^2\left(\frac{\theta}{2}\right)\cdot K'}{\left\{1-\left[R\sin^2\left(\frac{\theta}{2}\right)K'\right]^2\right\}} \approx \frac{1}{Mw}\left[1+R\sin^2\left(\frac{\theta}{2}\right)\cdot K'\right]$$

K: Optical constant

C: Concentration of polymer (g/ml)

R(O): Relative intensity of scattering light by scattering angle θ

$$P(\theta)=R(\theta)/R_O=1-R[(4\pi/\lambda)\sin(\theta/2)]^2/3$$

R: Inertial root mean square

λ: Wavelength of laser light in solution (nm)

That is, the square radius of inertia Rw is the value that commonly shows an extent of each molecule (per molecule), and hence it is considered that the degree of branching of each molecule is shown by dividing this value by Mw.

That is, it is considered that, the smaller the value of Rw/Mw is, the smaller the extent is for the molecular weight, and hence the molecule has a large degree of branching, and that, in reverse the larger the value of Rw/Mw is, the larger the extent is for the molecular weight, and hence the molecule is a straight-chain molecule.

Then, in order to reduce the density non-uniformity at the time of fixing, it is important to control the shape of toner particles. As the shape of toner particles is closer to a spherical shape, the toner can come closer to the closest packing when it forms images on the paper. As the toner comes closer to the closest packing, it can easily be improved in heat conductivity. Further, as points of contact between toner particles increase, the toner can easily be improved in heat conductivity to become improved in low-temperature fixing performance and besides can easily lessen the density non-uniformity. Also, as the shape of toner particles is closer to a spherical shape, the toner can easily be improved in its fluidity in a developing assembly, and can readily be uniformly electrostatically charged, and hence the toner is improved in developing performance and improved in dot reproducibility. That is, it is necessary for the toner of the present invention to have an average circularity of 0.960 or more.

The toner having an average circularity of 0.960 or more and further satisfying the molecular weight distribution as specified in the present invention can be improved in heat conductivity and further can achieve both the improvement in low-temperature fixing performance and the keeping of any excess fixing from occurring, so that it can more easily improved in the dot reproducibility than ever and also can keep the density non-uniformity from coming about.

This is because, in the toner having an average circularity of as high as 0.960 or more, so controlling as to satisfy the number-average molecular weight Mn(25° C.) and the value of Mn(135° C.)/Mn(25° C.) as specified herein makes the heat uniformly conductible to the toner at the time of fixing, further makes the toner particles readily deformable and also can keep the toner from being fixed in excess. Thus, the toner is improved in the dot reproducibility and can more remedy the density non-uniformity.

If the toner has an average circularity of lower than 0.960, it tends to have a low heat conductivity to tend to cause poor low-temperature fixing and density non-uniformity. Such a toner also tends to be non-uniformly charged in respect of development to tend to have low dot reproducibility.

Then, in the toner of the present invention, the molecular weight and molecular weight distribution of the toner are highly controlled by selecting the type of the binder resin and further making proper how to add a polymerization initiator(s) and how to produce toner particles.

The binder resin used in the present invention may include homopolymers of styrene and derivatives thereof, such as polystyrene and polyvinyltoluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins and polyacrylic acid resins, any of which may be used. Any of these may be used alone or in combination of two or more types. Of these, styrene copolymers are preferred in view of developing performance, fixing performance and so forth of the toner.

As a polymerization initiator used when the binder resin in the present invention is produced by radical polymerization, preferred is one having a half-life at the time of polymerization, of from 0.5 hour to 30 hours.

As a specific polymerization initiator, it may include azo type or diazo type polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, dilauroyl peroxide, t-butyl peroxy-2-ethylhexanoate, t-butyl peroxypivarate, di(2-ethylhexyl)peroxydicarbonate and di(secondary butyl)peroxydicarbonate. Of these, the peroxydicarbonate types di(2-ethylhexyl)peroxydicarbonate and di(secondary butyl)peroxydicarbonate may preferably be used.

The reason therefor is as stated below. Where such a peroxydicarbonate is used as the polymerization initiator, two carbonate radicals of the like species are formed upon its cleavage. Also, such carbonate radicals cannot easily cause any decarboxylation reaction, and hence the like radicals can easily be present in the reaction system, and the radical polymerization may well efficiently be initiated for any polymerizable monomer. Hence, its use in a smaller quantity compared with any conventional peroxide type polymerization initiator can make the binder resin have a low molecular weight. Further, inasmuch as its use in a smaller quantity can make the binder resin have a low molecular weight, any side reaction or the like cannot easily take place. Hence, the molecular weight distribution can readily be controlled, and in addition thereto the straight-chain type molecular structure can easily be made up, and hence, e.g., the release agent and the colorant can easily be improved in their dispersibility to make it easy to achieve high image quality.

In the case when the binder resin in the present invention is produced by the radical polymerization, it is also preferable for the polymerization initiator to be used at a temperature higher by 15° C. or more with respect to its 10-hour half-life temperature. The use of the polymerization initiator at the temperature higher by 15° C. or more makes it easy for the polymerization initiator to undergo its cleavage quickly, and makes it easy to make the binder resin have a low molecular weight. Also, the like radicals can easily be formed in the reaction system, and any side reaction or the like cannot easily take place. Hence, this makes it easy to form a binder resin the molecular weight distribution of which has been controlled.

As a way of adding the polymerization initiator, it may be added once all together or dividedly additionally. Adding it dividedly additionally makes it easy for the Mn(25° C.) and Mn(135° C.) featuring the present invention to be controlled within the desired ranges, and hence such a way of addition may preferably be used. As the time at which it is added dividedly additionally, it may preferably be added at a point of time that polymerization conversion is 50% or more to 95% or less. This is because the side reaction comes to tend to take place at a point of time that the polymerization conversion is 50% and afterwards, where the polymerization initiator may additionally be added, whereby the side reaction can be kept from taking place and the binder resin controlled structurally as in the present invention can be produced with ease.

It is also preferable in the toner of the present invention that, where a tetrahydrofuran-insoluble matter in the binder resin is represented by Gt (% by mass) and an acetone-insoluble matter in the binder resin is represented by Ga (% by mass), the tetrahydrofuran-insoluble matter Gt is from 5% by mass or more to 40% by mass or less and further the value of (Ga−Gt) is from 5% by mass or more to 25% by mass or less.

Inasmuch as the tetrahydrofuran-insoluble matter Gt is not less than 5% by mass, the toner can easily be kept from melting in excess, e.g., even where heat and pressure tend to be applied in excess at the time of fixing like that at hills of surface of thin paper. On the other hand, inasmuch as the tetrahydrofuran-insoluble matter Gt is not more than 40% by mass, the toner can easily melt, e.g., even where the toner cannot easily melt at the time of fixing like that at dales of surface of cardboard.

Inasmuch as the value of (Ga−Gt) is not less than 5% by mass, the toner can easily be improved in low-temperature fixing performance. On the other hand, inasmuch as the value of (Ga−Gt) is not more than 25% by mass, the toner can easily remedy the density non-uniformity.

The value of (Ga−Gt) is the difference between the insoluble matter Gt in binder resin that is insoluble in tetrahydrofuran, having a high polymer-dissolving power, and the insoluble matter Ga in binder resin that is insoluble in acetone, having a low polymer-dissolving power. That the value of (Ga−Gt) is from 5% by mass or more to 25% by mass or less shows that the difference between the Ga and the Gt is relatively small. Inasmuch as the difference between the Ga and the Gt is a small value, it follows that any soluble matter stands eluted at substantially the same level without regard to any polymer-dissolving power of the solvent. For example, in such cases as the following i) to iii), a low-molecular weight component can easily come eluted from a network structure formed by cross-linking, so that the difference between the Ga and the Gt can easily come to from 5% by mass or more to 25% by mass or less.

i) A case in which cross-linked points of a resin are in a large distance to form a large network structure.

ii) A case in which the polymer that is to dissolve has a relatively low molecular weight, like that having a number-average molecular weight Mn(25° C.) of from 500 or more to 3,000 or less.

iii) A case in which, even though a high-molecular weight component, the resin is highly soluble like that branched to a small extent.

In order to materialize that such a tetrahydrofuran-insoluble matter Gt is from 5% by mass or more to 40% by mass or less and further the value of (Ga−Gt) is from 5% by mass or more to 25% by mass or less, this can be achieved, e.g., by selecting or controlling the type of the polymerization initiator, the conditions for producing the toner particles, the type of a cross-linking agent, the keeping of any metal cross-linking from being caused by a metal contained in the colorant or the like, and by regulating the molecular structure and cross-link structure of the polymer that is to dissolve.

In order to produce such a resin, it is preferable to carry out polymerization with use of a cross-linking agent, which may be added in an amount of from 0.001 part by mass to 15 parts by mass based on 100 parts by mass of the polymerizable monomer.

As the cross-linking agent used in the present invention, a compound chiefly having at least two polymerizable double bonds may be used, which may include, e.g., aromatic divinyl compounds such as divinyl benzene and divinyl naphthalene; carboxylic esters having two double bonds, such as ethylene glycol diacrylate, ethylene glycol dimethacrylate, 1,3-butanediol dimethacrylate, triethylene glycol diacrylate, tetraethylene glycol diacrylate, polyethylene glycol diacrylate, 1,4-butanediol diacrylate, 1,5-pentanediol diacrylate, 1,6-hexanediol diacrylate, 1,7-heptanediol diacrylate, 1,8-octanediol diacrylate, 1,9-nonanediol diacrylate, 1,10-decanediol diacrylate, 1,11-undecanediol diacrylate, 1,18-octadecanediol diacrylate, neopentyl glycol diacrylate, tripropylene glycol diacrylate and polypropylene glycol diacrylate; divinyl compounds such as divinyl aniline, divinyl ether, divinyl sulfide and divinyl sulfone; and compounds having at least three vinyl groups; any of which may be used alone or in the form of a mixture of two or more types.

In particular, what may preferably be used are 1,4-butanediol diacrylate, 1,5-pentanediol diacrylate, 1,6-hexanediol diacrylate, 1,7-heptanediol diacrylate, 1,8-octanediol diacrylate, 1,9-nonanediol diacrylate, 1,10-decanediol diacrylate, 1,11-undecanediol diacrylate and 1,18-octadecanediol diacrylate, which are represented by the following formula.

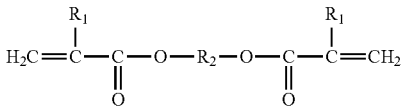

wherein $R_1$ represents a hydrogen atom or an alkyl group having 1 to 3 carbon atom(s), and $R_2$ represents a straight-chain alkylene group having 4 to 18 carbon atoms.

This is because the above compounds have a flexibility and has a relatively long molecular chain and hence cross-linked points of the resin can easily be in a large distance to form a large network structure with ease. Hence, this can easily promote deformation of the resin at the time of fixing, and the toner can easily be improved in fixing performance. Meanwhile, the resin has a cross-link structure, and hence the toner can keep its elasticity and hence bring out a high developing performance even during its long-term service.

Then, the toner of the present invention has a release agent. As the release agent used in the present invention, a release agent "a" and release agent "b" which are detailed later or any known wax may be added. As the known wax, it may specifically include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty acid amides such as linolic acid amide, oleic acid amide and lauric acid amide; saturated fatty acid bisamides such as methylenebis(stearic acid amide), ethylenebis(capric acid amide), ethylenebis(lauric acid amide) and hexamethylenebis(stearic acid amide); unsaturated fatty acid amides such as ethylenebis(oleic acid amide), hexamethylenebis(oleic acid amide), N,N'-dioleyladipic acid amide and N,N'-dioleylsebasic acid amide; aromatic bisamides such as m-xylenebisstearic acid amide and N,N'-distearylisophthalic acid amide; fatty acid metal salts (those commonly called metal soap) such as calcium stearate, calcium laurate, zinc stearate and magnesium stearate; and long-chain alkyl alcohols or long-chain alkyl carboxylic acids, which have 12 or more carbon atoms.

The toner of the present invention may preferably have, as the release agent, a release agent "a" and release agent "b" which are different in type. It is preferable that the release agent "a" is a monofunctional or bifunctional ester wax and the release agent "b" is a hydrocarbon wax.

The monofunctional or bifunctional ester wax used as the release agent "a" can easily have a good adaptability to the binder resin in the present invention, is dispersible in the toner particles and can easily provide the toner particles with plasticity, and the toner can easily be improved in fixing performance and remedy the density non-uniformity.

The monofunctional or bifunctional ester wax may specifically include waxes composed chiefly of a fatty ester, such as carnauba wax and montanate wax; those obtained by deoxidizing part or the whole of the acid component from fatty esters, such as dioxidized carnauba wax; methyl esterified products having a hydroxyl group, obtained by, e.g., hydrogenation of vegetable fats and oils; saturated aliphatic monoesters such as stearyl stearate and behenyl behenate; di-esterified products of saturated aliphatic dicarboxylic acids with saturated aliphatic alcohols, such as dibehenyl sebacate, distearyl dodecanedionate and distearyl octadecanedionate; and di-esterified products of saturated aliphatic diols with saturated fatty acids, such as nonanediol dibehenate and dodecanediol distearate. Of these, saturated aliphatic monoesters and di-esterified products may preferably be used.

The release agent "a" may preferably be used in an amount ranging from 5 parts by mass to 20 parts by mass based on 100 parts by mass of the binder resin. Inasmuch as it is used in an amount ranging from 5 parts by mass to 20 parts by mass, the release agent is well dispersible in the binder resin to make the toner improved in fixing performance and in development stability during its long-term service.

Then, the release agent used as the release agent "b" is a hydrocarbon wax. The hydrocarbon wax is so much highly hydrophobic on the whole as to readily form domains. For example, where the toner is produced by suspension polymerization as described later, the hydrocarbon wax can readily form nuclei in the vicinity of toner particle centers.

Thus, the hydrocarbon wax has a low adaptability to the binder resin, and hence it acts not to plasticize the binder resin when melted by fixing heat, but to exude from toner particles so as to be able to provide the toner with releasability from a fixing member. Hence, the toner can be improved in anti-offset properties.

The hydrocarbon wax may specifically include, e.g., aliphatic hydrocarbon waxes such as low-molecular weight polyethylene, low-molecular weight polypropylene, microcrystalline wax, paraffin wax and Fischer-Tropsch wax; oxides of aliphatic hydrocarbon waxes, such as polyethylene oxide wax, or block copolymers of these; and grafted waxes obtained by grafting vinyl monomers such as styrene or acrylic acid to fatty acid hydrocarbon waxes; any of which may be used. Paraffin wax and Fischer-Tropsch wax may preferably be used, and may be used in an amount ranging from 0.1 part by mass to 20 parts by mass based on 100 parts by mass of the binder resin.

In virtue of the use of the release agent "a" and the release agent "b" in combination, the effect of the release agent "a" that can readily contribute to the melting of the toner and that of the release agent "b" that can readily contribute to the releasability of the toner can simultaneously be brought out to enable the toner to bring out good fixing performance and releasability and enable the toner dramatically remedy any staining of a fixing film.

This is because the binder resin can have a preferable molecular structure and can stand low-molecular weight, where, as the monofunctional or bifunctional ester wax is present, it can readily enter the binder resin since the monofunctional or bifunctional ester wax has a structure of straight-chain type, to become readily adaptable to the binder resin, and hence the monofunctional or bifunctional ester wax can be improved in its dispersibility. Also, about the hydrocarbon wax, if the hydrocarbon wax is used alone, it is compatibilized with the binder resin and hence does not sufficiently bring out the releasability. However, as the monofunctional or bifunctional ester wax is present together, the monofunctional or bifunctional ester wax, which has hydrophobic nature close to that of the binder resin in degree, is preferentially compatibilized with the binder resin, so that the hydrocarbon wax, which has relatively high hydrophobic nature, can readily form domains. Hence, where, e.g., the toner is produced by suspension polymerization, the hydrocarbon wax can readily come present in the vicinity of toner particle centers.

Thus, the binder resin which is of straight-chain type and has been made low-molecular weight, the monofunctional or bifunctional ester wax and the hydrocarbon wax hydrocarbon wax are present together. This brings respective toner constituent materials into a preferable state of presence, and the toner can be seen to be improved in fixing performance.

The release agent a and the release agent b may preferably be those each having a maximum endothermic peak in the temperature range of from 60° C. to 85° C. at the time of heating, in a DSC curve as measured with a differential scanning calorimeter. Inasmuch as they each have a maximum endothermic peak in the above temperature range, the toner is improved in fixing performance and development stability. Also, it follows that the melting point of the release agent a and that of the release agent b are present within ranges relatively close to each other, and this enables the both to bring out their effects simultaneously at the time of fixing.

In the case when the toner particles are produced by suspension polymerization, which is a process for producing toner particles preferable for the present invention, the release agents can highly be soluble in the polymerizable monomer, and hence can easily be controlled to provide the desired state of dispersion of release agents.

As the ratio of content of the release agent a to that of the release agent b, it may preferably be within the range of from 1/1 to 20/1.

Then, the toner particles may preferably have a core/shell structure. As having shell layers, any external additive such as an inorganic fine powder can easily be kept from coming buried in the toner particles, and besides any components not readily participate in charging, such as the release agent, cannot easily be present on toner particle surfaces. Hence, the toner can readily electrostatically be charged and can easily be improved in dot reproducibility. Further, the toner is improved in storage stability.

As the shell layers, it is preferable to use an amorphous high-molecular weight material, which may preferably have an acid value of from 1.0 mgKOH/g to 20.0 mgKOH/g from the viewpoint of the stability of charging. Inasmuch as the high-molecular weight material used for the shell layers has an acid value of not more than 20.0 mgKOH/g, the toner can easily be made stable in its chargeability, and hence it is improved in developing performance especially in a high-temperature and high-humidity environment. Also, inasmuch as the high-molecular weight material used for the shell layers has an acid value of not less than 1.0 mgKOH/g, when, e.g., the toner particles are produced by suspension polymerization, the shell layers can readily be formed as having the acid value, and make the toner more improved in storage stability.

As a specific method for forming the shell layers, fine particles for shells may be embedded in core particles. Also, in the case when the toner particles are produced in an aqueous medium, ultra-fine particles for shells may be made to adhere to the core particles, and then dried to form the shell layers. Also, in the case of solution suspension or suspension polymerization, the acid value and hydrophilicity of the high-molecular weight material may be utilized so as to make the high-molecular weight material localized at interfaces between water and oil droplet particles, i.e., in the vicinity of the toner particle surfaces to form the shell layers. Further, the shell layers may also be formed by what is called seed polymerization, according to which a monomer is made to swell on core particle surfaces and then polymerized.

The high-molecular weight material used for the shell layers may include, e.g., homopolymers of styrene or derivatives thereof, such as polystyrene and polyvinyltoluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, a styrene-polyester copolymer, a polyacrylate-polyester copolymer, a polymethacrylate-polyester copolymer, polyamide resins, epoxy resins, polyacrylic acid resins, terpene resins and phenol resins. Any of these may be used alone or in the form of a mixture of two or more types. A functional group such as an amino group, a carboxyl group, a hydroxyl group, a sulfonic acid group, a glycidyl group or a nitrile group may also be introduced into any of these polymers.

Of these, it may preferably be a polyester resin. The polyester resin can readily have a polarity, and hence makes it easy for the toner to be improved in charging performance. The polyester resin also makes its glass transition point (Tg) controllable while relatively easily making its molecular weight low, and hence makes it easy to materialize stabilization of the chargeability of the toner during its long-term service without inhibiting its low-temperature fixing performance.

As the polyester resin used in the present invention, a saturated polyester resin or an unsaturated polyester resin, or the both, may be used under appropriate selection.

As the polyester resin used in the present invention, any conventional one may be used which is constituted of an alcohol component and an acid component. The both components are as exemplified below.

As the alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexane dimethanol, butenediol, octenediol, cyclohexene dimethanol, hydrogenated bisphenol A, a bisphenol derivative represented by the following formula (I):

(I)

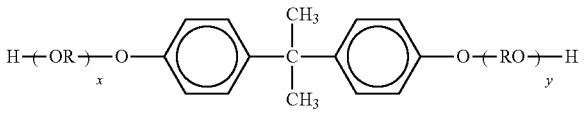

wherein R represents an ethylene group or a propylene group, x and y are each an integer of 1 or more, and an average value of x+y is 2 to 10;

or a hydrogenated product of the compound of the formula (I), and a diol represented by the following formula (II):

(II)

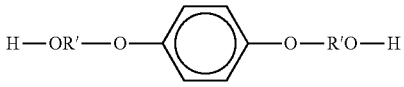

wherein R' represents —$CH_2CH_2$—, —$CH_2CH(CH_3)$—, or —$CH_2$—$C(CH_3)_2$—;

or a hydrogenated product diol of the compound of the formula (II).

As a dibasic carboxylic acid, it may include benzene dicarboxylic acids or anhydrides thereof, such as phthalic acid, terephthalic acid, isophthalic acid and phthalic anhydride; alkyldicarboxylic acids such as succinic acid, adipic acid, sebacic acid and azelaic acid, or anhydrides thereof, and also succinic acid substituted with an alkyl group having 6 to 18 carbon atoms, or anhydrides thereof; and unsaturated dicarboxylic acids such as fumaric acid, maleic acid, citraconic acid and itaconic acid, or anhydrides thereof.

The alcohol component may further include polyhydric alcohols such as glycerol, pentaerythritol, sorbitol, sorbitan, and oxyakylene ethers of novolak phenol resins. The acid component may include polycarboxylic acids such as trimellitic acid, pyromellitic acid, 1,2,3,4-butanetetracarboxylic acid and benzophenonetetracarboxylic acid or anhydrides thereof.

Of these polyester resins, preferably used is an alkylene oxide addition product of the above bisphenol A, which has superior charge characteristics and environmental stability and is well balanced in other electrophotographic performance. In the case of this compound, the alkylene oxide may preferably have an average addition molar number of from 2 to 10 in view of fixing performance and running performance of the toner.

The alcohol and acid constituting the polyester resin may preferably be in a unit ratio of from 45:55 to 55:45.

The polyester resin in the present invention may be produced in the presence of any catalyst such as a tin type catalyst, an antimony type catalyst or a titanium type catalyst. The titanium type catalyst may preferably be used.

Such polyester obtained by polycondensation using a titanium type catalyst can easily be a homogeneous polyester, and hence is preferable because the toner particles can readily uniformly be covered with it as outer shells.

The high-molecular weight material that forms the shell layers may also preferably have a number-average molecular weight of from 2,500 to 25,000. Inasmuch as it has a number-average molecular weight of not less than 2,500, the toner is improved in anti-blocking properties and running performance. Also, inasmuch as it has a number-average molecular weight of not more than 25,000, the toner is improved in low-temperature fixing performance as being preferable. Incidentally, this number-average molecular weight may be measured by GPC.

The polyester resin may preferably have a glass transition point (Tg) of 50° C. or more, and much preferably a Tg of 75° C. or more. Inasmuch as it has a Tg of 75° C. or more, the toner can easily be improved in stabilization of chargeability during its long-term service, and also can easily be made stably storable, as being much preferable.

The polyester resin used as the shell layers may preferably be in a content of from 3 parts by mass or more to 30 parts by mass or less, based on 100 parts by mass of the binder resin.

Inasmuch as the polyester resin is in a content of not less than 3 parts by mass, the toner particles can easily be improved in fluidity. Also, inasmuch as the polyester resin is in a content of not more than 30 parts by mass, the release agent, colorants and so forth can easily be improved in dispersibility, and the toner is improved in low-temperature fixing performance.

Then, the toner of the present invention contains a colorant(s) matched with any intended color tint(s). The colorant(s) used in the toner of the present invention may include known organic pigments or dyes, carbon black and magnetic materials, any of which may be used.

Stated specifically, as cyan colorants, usable are copper phthalocyanine compounds and derivatives thereof, anthraquinone compounds, basic dye lake compounds and so forth. Stated specifically, they may include C.I. Pigment Blue 1, 7, 15, 15:1, 15:2, 15:3, 15:4, 60, 62 and 66.

As magenta colorants, usable are condensation azo compounds, diketopyrrolopyrrole compounds, anthraquinone compounds, quinacridone compounds, basic-dye lake compounds, naphthol compounds, benzimidazolone compounds, thioindigo compounds and perylene compounds. Stated specifically, they may include C.I. Pigment Red 2, 3, 5, 6, 7, 23, 48:2, 48:3, 48:4, 57:1, 81:1, 122, 144, 146, 166, 169, 177, 184, 185, 202, 206, 220, 221 and 254; and C.I. Pigment Violet 19.

As yellow colorants, usable are compounds typified by condensation azo compounds, isoindolinone compounds, anthraquinone compounds, azo metal complexes, methine compounds and allylamide compounds. Stated specifically, they may include C.I. Pigment Yellow 12, 13, 14, 15, 17, 62, 74, 83, 93, 94, 95, 97, 109, 110, 111, 120, 127, 128, 129, 147, 151, 154, 168, 174, 175, 176, 180, 181, 191 and 194.

Any of these colorants may be used alone, in the form of a mixture, or further in the state of a solid solution. The colorant used in the toner of the present invention is selected taking account of hue angle, chroma, brightness, light-fastness, transparency on OHP films and dispersibility in toner particles. The colorant may preferably be added in an amount of from 1 part by mass to 20 parts by mass based on 100 parts by mass of the binder resin.

As black colorants, carbon black, a magnetic material and a colorant toned in black by the use of yellow, magenta and cyan colorants shown above may be used. In the case when the carbon black is used as a black colorant, it may preferably be used in its addition in an amount of from 1 part by mass to 20 parts by mass based on 100 parts by mass of the binder resin.

Of these, it is preferable that the colorant is a magnetic material having been hydrophobic-treated. For example, where the toner particles are produced in an aqueous medium as in suspension polymerization, and inasmuch as the colorant is such a magnetic material having been hydrophobic-treated, the colorant can relatively easily be made well dispersible in the toner particles to make it easy to improve density and gloss at the time of fixing. Also, inasmuch as it is hydrophobic-treated, the magnetic material can be made highly dispersible in the toner particles, and the amount of heat the toner has from a fixing assembly at the time of fixing can be constant between individual toner particles to enable uniform fixing.

In the case when the magnetic material is used as a black colorant, the magnetic material may preferably be used in an amount of from 20 parts by mass to 150 parts by mass based on 100 parts by mass of the binder resin. Inasmuch as the magnetic material is added in an amount of not less than 20 parts by mass, the toner can have a high coloring power and also can easily keep fog from occurring. Also, inasmuch as it is in an amount of not more than 150, the toner as such can have an appropriate endothermic calorie, promising a good fixing performance.

The content of the magnetic material in the toner may be measured with a thermal analyzer TGA7, manufactured by Perkin-Elmer Corporation. A measuring method is as follows: The toner is heated at a heating rate of 25° C./minute from normal temperature to 900° C. in an atmosphere of nitrogen. The mass (%) of weight loss in the course of from 100° C. to 750° C. is regarded as the binder resin weight, and the residual mass is approximately regarded as the magnetic-material weight.

In the case when in the present invention the toner is produced by polymerization, attention must be paid to polymerization inhibitory action or aqueous-phase transfer properties inherent in the colorant. Accordingly, it is better for the colorant to have been subjected to surface modification, e.g., hydrophobic treatment with a material free from any polymerization inhibition. In particular, most dyes and carbon black have the polymerization inhibitory action and hence care must be taken when used.

With regard to the carbon black, it may be treated with a material capable of reacting with surface functional groups of the carbon black, as exemplified by a polyorganosiloxane.

In the case when the magnetic material is used in the toner of the present invention, the magnetic material is what is chiefly composed of a magnetic iron oxide such as triiron tetraoxide or γ-iron oxide, and may also contain any of elements such as phosphorus, cobalt, nickel, copper, magnesium, manganese, aluminum and silicon. Any of these magnetic materials may preferably have a BET specific surface area, as measured by the nitrogen gas adsorption method, of from 2 $m^2/g$ or more to 30 $m^2/g$ or less, and much preferably from 3 $m^2/g$ or more to 28 $m^2/g$ or less. It may also preferably be one having a Mohs hardness of from 5 to 7. As the particle shape of the magnetic material, it may be, e.g., polygonal, octahedral, hexahedral, spherical, acicular or flaky. Polygonal, octahedral, hexahedral or spherical ones are preferred as having less anisotropy, which are preferable in order to improve image density.

The magnetic material may preferably have a volume-average particle diameter (Dv) of from 0.10 μm or more to 0.40 μm or less. Inasmuch as it has a volume average particle diameter (Dv) of not less than 0.10 μm, the magnetic material cannot easily agglomerate, and the magnetic material is improved in its uniform dispersibility in the toner particles. Also, inasmuch as it has a volume average particle diameter (Dv) of not more than 0.40 μm, the toner is improved in its coloring power, and hence such a magnetic material may preferably be used.

The volume-average particle diameter of the magnetic material may be measured with a transmission electron microscope. Stated specifically, toner particles to be observed are well dispersed in epoxy resin, followed by curing for 2 days in an environment of temperature 40° C. to obtain a cured product. The cured product obtained is cut out in slices by means of a microtome to prepare a sample, where the particle diameter of 100 magnetic material particles in the visual field is measure on a photograph taken at 10,000 magnifications to 40,000 magnifications using a transmission electron microscope (TEM). Then, the volume-average particle diameter (Dv) is calculated on the basis of circle-equivalent diameter equal to the particle projected area of the magnetic material. The particle diameter may also be measured with an image analyzer.

The magnetic material usable in the toner of the present invention may be produced in the following way, for example.

To an aqueous ferrous salt solution, an alkali such as sodium hydroxide is added in an equivalent weight, or more than equivalent weight, with respect to the iron component to prepare an aqueous solution containing ferrous hydroxide. Into the aqueous solution thus prepared, air is blown while its pH is maintained at pH 7 or above, and the ferrous hydroxide is made to undergo oxidation reaction while the aqueous solution is heated at 70° C. or more to firstly form seed crystals serving as cores of magnetic ion oxide particles.

Next, to a slurry-like liquid containing the seed crystals, an aqueous solution containing ferrous sulfate in about one equivalent weight on the basis of the quantity of the alkali previously added is added. The reaction of the ferrous hydroxide is continued while the pH of the liquid is maintained at 5 to 10 and air is blown, to cause magnetic iron oxide particles to grow about the seed crystals as cores. At this stage, any desired pH, reaction temperature and stirring conditions may be selected so that the particle shape and magnetic properties of the magnetic material can be controlled. With progress of oxidation reaction, the pH of the liquid comes to shift to acid side, but the pH of the liquid may preferably be so adjusted as not to be made less than 5. The magnetic material thus obtained may be filtered, followed by washing and then drying all by conventional methods to obtain the magnetic material. Here, well removing impurities such as a metal or a metal oxide by washing makes any side reaction such as metal cross-linking not easily take place when making up the toner particles, and hence the washing may preferably be sufficiently carried out.

In the case when in the present invention the toner is produced by polymerization, it is very preferable for the particle surfaces of the magnetic material to be subjected to hydrophobic treatment. Where such hydrophobic treatment is carried out by a dry process, a coupling agent is added to the magnetic material obtained as a result of washing, filtration and drying, to carry out hydrophobic treatment. Where the hydrophobic treatment is carried out by a wet process, those having been dried after the oxidation reaction has been completed are again dispersed. As another method, the iron oxide material obtained by the oxidation reaction having been completed, followed by washing and filtration, may be again dispersed in a different aqueous medium without being dried, to carry out coupling treatment. Stated specifically, a silane coupling agent is added to the one dispersed again, with its thorough stirring, and the temperature may be raised after hydrolysis or the pH of the dispersion may be adjusted to the alkaline side to carry out coupling treatment. Of these, from the viewpoint of carrying out uniform hydrophobic treatment, it is preferable that what has been obtained by the oxidation reaction having been completed, followed by filtration and washing, is formed into a slurry as it is, without being dried, and then the hydrophobic treatment is carried out.

To carry out the hydrophobic treatment of the magnetic material by the wet process, i.e., the magnetic material is treated with a coupling agent in an aqueous medium, the magnetic material is first sufficiently dispersed in the aqueous medium so as to become primary particles, and then stirred with a stirring blade or the like so as not to settle or agglomerate. Next, the coupling agent is introduced in the resultant dispersion in any desired amount, and the hydrophobic treatment is carried out while hydrolyzing the coupling agent. In this case as well, it is much preferable to carry out the hydrophobic treatment with stirring and while carrying out dispersion sufficiently so as not to cause any agglomeration using an apparatus such as a pin mill or a line mill.

Here, the aqueous medium is a medium composed chiefly of water. Stated specifically, it may include water itself, water to which a surface-active agent has been added in a small quantity, water to which a pH adjuster has been added, and water to which an organic solvent has been added. As the surface-active agent, a nonionic surface-active agent such as polyvinyl alcohol is preferred. The surface-active agent may preferably be added in an amount of from 0.1% by mass to 5.0% by mass based on the mass of the water. The pH adjuster may include inorganic acids such as hydrochloric acid. The organic solvent may include alcohols.

The coupling agent usable in the hydrophobic treatment of the magnetic material in the present invention may include, e.g., silane coupling agents and titanium coupling agents. Preferably usable is a silane coupling agent, which is one represented by the general formula (1):

$$R_mSiY_n \quad (1)$$

wherein R represents an alkoxyl group; m represents an integer of 1 or more to 3 or less; Y represents an alkyl group or a vinyl group, and the alkyl group may have a functional group such as an epoxy group, a hydroxyl group, an acrylic group or a methacrylic group; and n represents an integer of 1 or more to 3 or less, provided that m+n=4.

The silane coupling agent represented by the general formula (1) may include, e.g., vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane and n-octadecyltrimethoxysilane.

Of these, from the viewpoint of providing the magnetic material with a high hydrophobicity, an alkyltrialkoxysilane coupling agent represented by the following formula (B) may preferably be used.

$$C_pH_{2p+1}—Si—(OC_qH2_{q+1})_3 \quad (2)$$

wherein p represents an integer of 2 to 20, and q represents an integer of 1 to 3.

In the above formula, inasmuch as the p is an integer of from 2 to 20 (preferably an integer of from 3 to 15), providing the magnetic material with hydrophobicity can well be balanced with keeping magnetic material particles from coalescing mutually. Also, inasmuch as the q is an integer of from 1 to 3 (preferably an integer of 1 or 2), the silane coupling agent can have a sufficient reactivity to make the magnetic material well hydrophobic.

In the case when the above silane coupling agent is used, the treatment may be carried out using it alone, or using a plurality of types in combination. In using a plurality of types in combination, the treatment may be carried out using the respective coupling agents separately, or the treatment may be carried out using them simultaneously.

The coupling agent used may preferably be in a total treatment quantity of from 0.9 part by mass to 3.0 parts by mass based on 100 parts by mass of the magnetic material, and it is important to control the amount of the treating agent in accordance with the surface area of the magnetic material, the reactivity of the coupling agent, and so forth.

In the present invention, in addition to the magnetic material, other colorant may also be used in combination. Such a colorant usable in combination may include magnetic or non-magnetic inorganic compounds besides the above known dyes and pigments. Stated specifically, it may include ferromagnetic metal particles of cobalt, nickel or the like, or particles of alloys of any of these metals to which chromium, manganese, copper, zinc, aluminum, a rare earth element or the like has been added; as well as particles of hematite or the like, titanium black, nigrosine dyes or pigments, carbon black, and phthalocyanine. These may also be used after their particle surface hydrophobic treatment.

The toner of the present invention may optionally be mixed with a charge control agent in order to improve charging performance. As the charge control agent, any known charge control agent may be used. In particular, charge control agents which can give speedy charging and also can maintain a constant charge quantity stably are preferred. Further, where the toner particles are produced by polymerization as described later, it is particularly preferable to use charge control agents having a low polymerization inhibitory action and being substantially free of any solubilizate to the aqueous dispersion medium. Among such charge control agents, as specific compounds, they may include, as negative charge control agents, metal compounds of aromatic carboxylic acids such as salicylic acid, alkylsalicylic acids, dialkylsalicylic acids, naphthoic acid and dicarboxylic acids; metal salts or metal complexes of azo dyes or azo pigments; polymeric compounds having a sulfonic acid or carboxylic acid group in the side chain; and boron compounds, urea compounds, silicon compounds, and carixarene. As positive charge control agents, they may include quaternary ammonium salts, polymeric compounds having such a quaternary ammonium salt in the side chain, guanidine compounds, Nigrosine compounds and imidazole compounds.

As methods for making toner particles contain the charge control agent, commonly available are a method of internally adding it to the toner particles, and, in the case when the toner particles are produced by suspension polymerization, a method in which the charge control agent is added to a polymerizable monomer composition before its granulation. Also, a polymerizable monomer in which the charge control agent has been dissolved or suspended may be added in the midst of forming oil droplets in water to effect polymerization, or after the polymerization, to carry out seed polymerization so as to cover toner particle surfaces uniformly. Further, where an organometallic compound is used as the charge control agent, such a compound may be added to the toner particles and these may be mixed and agitated under application of a shear to incorporate it into toner particles.

The quantity of such a charge control agent used depends on the type of the binder resin, the presence of any other additives, and the manner by which the toner is produced, inclusive of the manner of dispersion, and cannot absolutely be specified. When added internally, however, the charge control agent may preferably be used in an amount ranging from 0.1 part by mass to 10.0 parts by mass, and much preferably from 0.1 part by mass to 5.0 parts by mass, based on 100 parts by mass of the binder resin. Also, when added externally, it may preferably be added in an amount of from 0.005 part by mass to 1.0 part by mass, and much preferably from 0.01 part by mass to 0.3 part by mass, based on 100 parts by mass of the toner particles.

The toner of the present invention may preferably have a weight-average particle diameter (D4) of from 5.0 μm to 9.0 μm in order to achieve sufficient image characteristics. Inasmuch as it has a weight-average particle diameter (D4) of not less than 5.0 μm, the toner can readily be controlled for its layer thickness by a developing blade, and can readily uniformly be charged. Also, inasmuch as it has a weight-average particle diameter (D4) of not more than 9.0 μm, the toner can easily be improved in dot reproducibility, and can easily obtain images with high definition.

The toner of the present invention may preferably have a glass transition temperature (Tg) of from 40° C. to 70° C. Inasmuch as it has a glass transition temperature (Tg) of not less than 40° C., the toner is improved in storage stability and at the same time the toner cannot easily deteriorate during its long-term service. Also, inasmuch as it has a glass transition temperature (Tg) of not more than 70° C., the toner is improved in fixing performance. Thus, taking account of balance between fixing performance, storage stability and developing performance, it is preferable for the toner to have the glass transition temperature (Tg) of from 40° C. to 70° C.

The toner of the present invention may be produced by any known process. First, where it is produced by a pulverization process, for example, components necessary as the toner, such as the binder resin, the colorant, the release agent and the charge control agent, and other additives, are thoroughly mixed by means of a mixer such as Henschel mixer or a ball mill. Thereafter, the mixture obtained is melt-kneaded by means of a heat kneading machine such as a heat roll, a kneader or an extruder to make toner materials dispersed or dissolved, followed by cooling to solidify, then pulverization, thereafter classification, and optionally surface treatment to obtain toner particles. Either of the classification and the surface treatment may be first in order. In the step of classification, a multi-division classifier may preferably be used in view of production efficiency.

The pulverization step may be carried out by using a known pulverizer such as a mechanical impact type or a jet type. In order to obtain the toner having the circularity preferable in the present invention, it is also preferable to further apply heat to effect pulverization or to carry out treatment of adding mechanical impact auxiliarily. Also usable are a hot-water bath method in which toner particles finely pulverized (and optionally classified) are dispersed in hot water, a method in which the toner particles are passed through hot-air streams, and so forth.

As means for applying mechanical impact force, available are, e.g., a method making use of a mechanical impact type pulverizer such as Kryptron system, manufactured by Kawasaki Heavy Industries, Ltd., or Turbo mill, manufactured by Turbo Kogyo Co., Ltd. A method may also be used in which toner particles are pressed against the inner wall of a casing by centrifugal force by means of a high-speed rotating blade to impart mechanical impact force to the toner particles by the force such as compression force or frictional force, as in apparatus such as a mechanofusion system manufactured by Hosokawa Micron Corporation or a hybridization system manufactured by Nara Machinery Co., Ltd. As the method in which the toner particles are passed through hot-air streams, a method employing METEO RAINBOW (manufactured by Nippon Pneumatic Mfg. Co., Ltd.) is available.

The toner of the present invention may be produced by the pulverization process as described above. However, the toner particles obtained by such pulverization commonly have an amorphous shape, and hence any mechanical and thermal or any special treatment must be carried out in order to attain the uniform charging performance as in the present invention. This may result in an inferior productivity. Accordingly, the toner of the present invention may preferably be obtained by producing toner particles in an aqueous medium, as in dispersion polymerization, association agglomeration, dissolution suspension or suspension polymerization. The production of toner particles in an aqueous medium makes it easy to obtain the spherical toner and the toner highly structurally controlled that are characteristic of the present invention.

In particular, in the suspension polymerization, the toner particles are produced from the polymerizable monomer, and hence any liquid viscosity at the initial stage of production can readily be lowered, and the state of presence of the colorant and release agent can readily be controlled. Further, this process is very preferable because it can readily satisfy preferable physical properties required in the present invention, such that the particle shape can readily be made so uniform as to readily achieve uniform charging, and that the toner can readily uniformly be provided with heat at the time of fixing.

The suspension polymerization is a process in which the polymerizable monomer and the colorant (and further optionally the polymerization initiator, the cross-linking agent, the charge control agent and other additives) are uniformly dissolved or dispersed to make up a polymerizable monomer composition. Thereafter, this polymerizable monomer composition is dispersed in a continuous phase (e.g., an aqueous phase) containing a dispersion stabilizer, by means of a suitable stirrer to carry out polymerization simultaneously to obtain a toner having the desired particle diameters. In the toner obtained by this suspension polymerization (hereinafter also termed "polymerization toner"), the individual toner particles stand uniform in a substantially spherical shape, and hence the toner can readily be obtained which satisfies the requirements on physical properties that are preferable in the present invention, such as the uniform charging and the dispersibility of colorants.

In producing the polymerization toner, the polymerizable monomer may include the following.

The polymerizable monomer may include styrene monomers such as styrene, o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamides. Any of these monomers may be used alone or in the form of a mixture.

Of the foregoing monomers, styrene or a styrene derivative may preferably be used alone or in the form of a mixture with other monomer. This is preferable in view of developing performance and running performance of the toner. Such other monomer may much preferably be an alkyl acrylate.

The reason therefor is that, inasmuch as the monomer is chiefly composed of styrene and an alkyl acrylate, the molecular weight and glass transition point of the polyester resin can readily be regulated, which also has a low polarity and hence the state of presence of a polar material or the like constituting the toner can readily be controlled.

As the polymerization initiator used in producing the toner of the present invention by polymerization, preferred is one having a half-life of from 0.5 hour to 30 hours at the time of polymerization reaction. It may also be used in its addition in an amount of from 0.5 part by mass to 20 parts by mass based on 100 parts by mass of the polymerizable monomer, to carry out polymerization. This enables a polymer to be obtained which has a maximum value within the range of molecular weight of from 5,000 to 50,000 and enables the toner to be endowed with a desirable strength and appropriate melt properties.

As polymerization reaction temperature, it is also preferable for the polymerization reaction to be carried out at a temperature that is higher by from 15° C. or more to 35° C. or less, than the 10-hour half-life temperature of the polymerization initiator. Carrying out the polymerization reaction at a temperature higher by from 15° C. or more to 35° C. or less accelerates the polymerization reaction, and can easily keep the binder resin from being branched or cross-linked in excess.

As examples of a specific polymerization initiator, the polymerization initiator described previously may be used. In particular, the peroxydicarbonate types di(2-ethylhexyl)peroxydicarbonate and di(secondary butyl)peroxydicarbonate may preferably be used because they make the polymerization reaction temperature controllable to the temperature that is higher by from 15° C. or more to 35° C. or less, than the 10-hour half-life temperature, and make it easy to produce the binder resin having a low-molecular weight and being of straight-chain type.

In the method of producing the toner of the present invention by polymerization, commonly a polymerizable monomer composition prepared by adding the above toner-composing materials appropriately and dissolving or dispersing them uniformly by means of a dispersion machine such as a homogenizer, a ball mill or an ultrasonic dispersion machine is suspended in an aqueous medium containing a dispersion stabilizer. Here, a high-speed dispersion machine such as a high-speed stirrer or an ultrasonic dispersion machine may be used to make the toner particles have the desired particle size at a stretch. This can more readily make the resultant toner particles have a sharp particle size distribution. As the time at which the polymerization initiator is added, it may be added simultaneously when other additives are added to the polymerizable monomer, or may be mixed immediately before they are suspended in the aqueous medium. Also, immediately after granulation, a polymerization initiator having been dissolved in the polymerizable monomer or solvent may be added before the polymerization reaction is initiated.

After granulation, agitation may be carried out using a usual agitator in such an extent that the state of particles is maintained and also the particles can be prevented from floating and settling.

When the toner of the present invention is produced, any of known surface-active agents or organic or inorganic dispersants may be used as a dispersion stabilizer. In particular, the inorganic dispersants attain dispersion stability on account of their steric hindrance and hence, even when reaction temperature is changed, they may hardly loose the stability, can be washed with ease and may hardly adversely affect toners, and hence they may preferably be used. As examples of such inorganic dispersants, they may include phosphoric acid polyvalent metal salts such as tricalcium phosphate, magnesium phosphate, aluminum phosphate, zinc phosphate and hydroxyapatite; carbonates such as calcium carbonate and magnesium carbonate; inorganic salts such as calcium metasilicate, calcium sulfate and barium sulfate; and inorganic compounds such as calcium hydroxide, magnesium hydroxide and aluminum hydroxide.

Any of these inorganic dispersants may preferably be used in an amount of from 0.2 part by mass to 20 parts by mass based on 100 parts by mass of the polymerizable monomer. The above dispersion stabilizer may be used alone or in combination of two or more types. A surface-active agent may further be used in combination in an amount of from 0.001 part by mass to 0.1 part by mass based on 100 parts by mass of the polymerizable monomer.

When these inorganic dispersants are used, they may be used as they are. In order to obtain finer particles, particles of the inorganic dispersant may be formed in the aqueous medium when used. For example, in the case of tricalcium phosphate, an aqueous sodium phosphate solution and an aqueous calcium chloride solution may be mixed under high-speed agitation, whereby water-insoluble calcium phosphate can be formed and more uniform and finer dispersion can be carried out. Here, water-soluble sodium chloride is simultaneously formed as a by-product. However, the presence of such a water-soluble salt in the aqueous medium keeps the polymerizable monomer from being dissolved in water, to make any ultrafine toner particles not easily become formed by emulsion polymerization, and hence this is more favorable.

Such a surface-active agent may include, e.g., sodium dodecylbenzenesulfate, sodium tetradecyl sulfate, sodium pentadecyl sulfate, sodium octyl sulfate, sodium oleate, sodium laurate, sodium stearate and potassium stearate.

In the step of polymerizing the polymerizable monomer, the polymerization may be carried out at a polymerization temperature set at 40° C. or more, and commonly at a temperature of from 50° C. to 90° C. Inasmuch as the polymerization is carried out within this temperature range, the low-melting material can better be enclosed in toner particles.

The polymerization toner particles obtained may be, after the polymerization has been completed, subjected to filtration, washing and drying by conventional methods to obtain the toner particles (herein refer to "toner base particles" when applicable as toner particles standing before any external additive is added thereto). The toner particles thus obtained may optionally be mixed (external addition) with an inorganic fine powder describe later. A classification step may also be added to the production steps (before mixing with the inorganic fine powder) so as to remove coarse powder and fine powder present mixedly with the toner particles.

In the present invention, an inorganic fine powder having a number-average primary particle diameter of from 4 nm to 80 nm, and preferably from 6 nm or more to 40 nm or less, may externally be added to the toner particles (toner base particles) as a fluidizing agent. This is also a preferred embodiment. The inorganic fine powder is added in order to improve the fluidity of the toner and make the charging of the toner particles uniform, where the inorganic fine powder may be subjected to treatment such as hydrophobic treatment so that the toner may be endowed with the function to regulate its charge quantity and improve its environmental stability. This is also a preferred embodiment.

In the present invention, the number-average primary particle diameter of the inorganic fine powder may be measured with a scanning electron microscope, using a photograph of toner particles which is taken under magnification.

As the inorganic fine powder used in the present invention, fine silica powder, fine titanium oxide powder, fine alumina powder or the like may be used. As the fine silica powder, usable are, e.g., what is called dry-process silica or fumed silica produced by vapor phase oxidation of silicon halides and what is called wet-process silica produced from water glass or the like, either of which may be used. However, the dry-process silica is preferred, as having less silanol groups on the particle surfaces and particle interiors of the fine silica powder and leaving less production residues such as $Na_2O$ and $SO_3^{2-}$. In the dry-process silica, it is also possible to use, e.g., in its production step, other metal halide such as aluminum chloride or titanium chloride together with the silicon halide to give a composite fine powder of silica with other metal oxide. The fine silica powder includes such a powder as well.

The inorganic fine powder having a number-average primary particle diameter of from 4 nm or more to 80 nm or less may preferably be added in an amount of from 0.1% by mass to 3.0% by mass based on the mass of the toner particles. The content of the inorganic fine powder may quantitatively be determined by fluorescent X-ray analysis and using a calibration curve prepared from a standard sample.

In the present invention, as mentioned above, the inorganic fine powder may be a powder having been hydrophobic-treated. This is preferable because the toner can be improved in environmental stability. As a treating agent used for such hydrophobic treatment of the inorganic fine powder, usable are treating agents such as a silicone varnish, a modified silicone varnish of various types, a silicone oil, a modified silicone oil of various types, a silane compound, a silane coupling agent, other organosilicon compound and an organotitanium compound, any of which may be used alone or in combination of two or more types.

Of such treating agents, those having been treated with silicone oil are preferred. Those obtained by subjecting the inorganic fine powder to hydrophobic treatment with a silane compound and, simultaneously with or after the treatment, treatment with silicone oil are much preferred. As a method for such treatment of the inorganic fine powder, for example, it may be treated, as first-stage reaction, with the silane compound to effect silylation reaction to cause silanol groups to disappear by chemical coupling, and thereafter, as second-stage reaction, with the silicone oil to form hydrophobic thin films on particle surfaces.

The silicone oil may preferably be one having a viscosity at 25° C. of from 10 $mm^2/s$ or more to 200,000 $mm^2/s$ or less, and much preferably from 3,000 $mm^2/s$ or more to 80,000 $mm^2/s$ or less.

As the silicone oil used, particularly preferred are, e.g., dimethylsilicone oil, methylphenylsilicone oil, α-methylstyrene modified silicone oil, chlorophenylsilicone oil and fluorine modified silicone oil.

As a method for treating the inorganic fine powder with the silicone oil, e.g., a method is available in which the inorganic fine powder having been treated with a silane compound and the silicone oil may directly be mixed by means of a mixer such as Henschel mixer, or a method is available in which the silicone oil is sprayed on the inorganic fine powder. Instead, a method may also be used in which the silicone oil is dissolved or dispersed in a suitable solvent and thereafter the inorganic fine powder is added thereto and mixed, followed by removal of the solvent. In view of an advantage that agglomerates of the inorganic fine powder may less form, the method of spraying is preferred.

The silicone oil may be used for the treatment in an amount of from 1 part by weight to 40 parts by weight, and preferably from 3 part by weight to 35 parts by weight, based on 100 parts by weight of the inorganic fine powder having not been treated, where the inorganic fine powder can readily be made well hydrophobic.

In order to endow the magnetic toner with a good fluidity, the inorganic fine powder used in the present invention may preferably be one having a specific surface area ranging from 20 $m^2/g$ to 350 $m^2/g$, and much preferably from 25 $m^2/g$ to 300 $m^2/g$, as measured by the BET method utilizing nitrogen absorption. The specific surface area is measured according to the BET method, where nitrogen gas is adsorbed on sample surfaces using a specific surface area measuring device AUTOSOBE 1 (manufactured by Yuasa Ionics Co.), and the specific surface area is calculated by the BET multiple point method.

In the toner of the present invention, other additives may further be used, as exemplified by lubricant powders such as fluorine resin powder, zinc stearate powder and polyvinylidene fluoride powder; abrasives such as cerium oxide powder, silicon carbide powder and strontium titanate powder; fluidity-providing agents such as titanium oxide powder and aluminum oxide powder; and anti-caking agents; as well as reverse-polarity organic and/or inorganic fine particles, which may also be used in a small quantity as a developability improver. These additives may also be used after hydrophobic treatment of their particle surfaces.

An example of an image forming apparatus in which the toner of the present invention is preferably usable is specifically described below with reference to the drawings.

In an image forming apparatus shown in FIG. 1, reference numeral 100 denotes a photosensitive drum, around which provided are a primary charging roller 117, a developing assembly 140, a transfer charging roller 114, a cleaner 116, a registration roller 124 and so forth. Then, the photosensitive drum 100 is electrostatically charged to −700 V by means of the primary charging roller 117 (applied voltage: AC voltage of −2.0 kVpp and DC voltage of −700 Vdc), and then the photosensitive drum 100 is exposed by irradiating it with laser light 123 by means of a laser generator 121. An electrostatic latent image formed on the photosensitive drum 100 is developed with a one-component magnetic developer (a toner) by means of the developing assembly 140 to form a toner image, which is then transferred to a transfer material by means of the transfer roller 114 brought into contact with the photosensitive drum via the transfer material. The transfer material holding the toner image thereon is transported to a fixing assembly 126 by a transport belt 125, and the toner image is fixed onto the transfer material. Any toner left partly on the photosensitive drum is removed by the cleaning means 116 to clean the surface.

Figure 2:
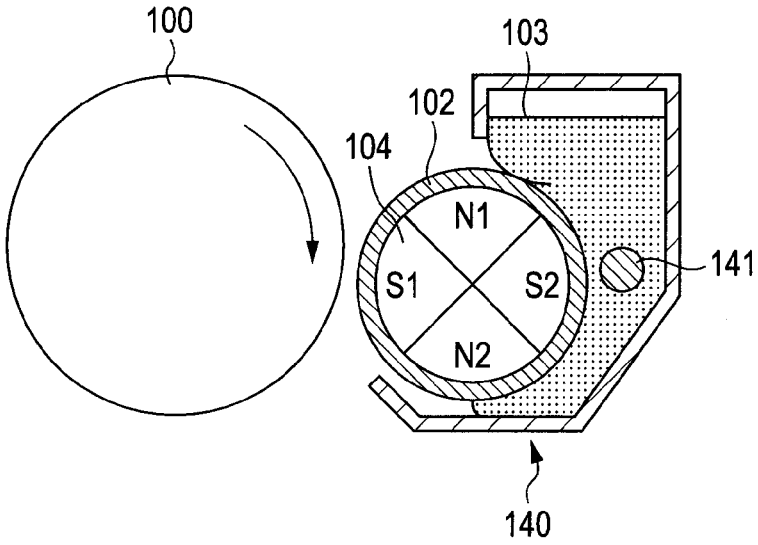
FIG. 2 is an enlarged view of a developing section.

The developing assembly 140 has, as shown in FIG. 1 or 2, a cylindrical toner carrying member (hereinafter "developing sleeve") 102 made of a non-magnetic metal such as aluminum or stainless steel, in the state it is in proximity to the photosensitive drum 100. A gap between the photosensitive drum 100 and the developing sleeve 102 is maintained at a distance of about 300 μm by the aid of a sleeve-to-photosensitive drum gap retaining member (not shown). In the interior of the developing sleeve 102, a magnet roller 104 is stationarily so provided as to be concentric to the developing sleeve 102. However, the developing sleeve 102 is rotatable.

The magnet roller 104 has a plurality of magnetic poles as shown in FIG. 2, where S1 operates on development; N1, control of toner coat level; S2, take-in and transport of the toner; and N2, prevention of the toner from spouting. The toner is coated on the developing sleeve 102 by a toner coating roller 141, and is transported adhering thereto. As a member which controls the level of the toner thus transported, an elastic blade 103 is provided. The level of the toner to be transported to a developing zone is controlled by the pressure at which the elastic blade 103 comes into touch with the developing sleeve 102. In the developing zone, DC and AC developing biases are applied across the photosensitive drum 100 and the developing sleeve 102, and the toner on the developing sleeve flies onto the photosensitive drum 100 in accordance with the electrostatic latent image to come into a visible image.

How to measure respective physical properties in the present invention are describe below.

Average Particle Diameter and Particle Size Distribution of Toner:

The weight-average particle diameter (D4) of the toner is calculated in the following way. A precision particle size distribution measuring instrument "Coulter Counter Multisizer 3" (registered trademark; manufactured by Beckman Coulter, Inc.) is used as a measuring instrument, which has an aperture tube of 100 μm in size and employing the aperture impedance method. To set the conditions for measurement and analyze the data of measurement, software "Beckman Coulter Multisizer 3 Version 3.51" (produced by Beckman Coulter, Inc.) is used, which is attached to Multisizer 3 for its exclusive use. Here, the measurement is made through 25,000 channels as effective measuring channels in number.

As an aqueous electrolytic solution used for the measurement, a solution may be used which is prepared by dissolving guaranteed sodium chloride in ion-exchanged water in a concentration of about 1% by mass, e.g., "ISOTON II" (available from Beckman Coulter, Inc.).

Before the measurement and analysis are made, the software for exclusive use is set in the following way.

On a "Change of Standard Measuring Method (SOM)" screen of the software for exclusive use, the total number of counts of a control mode is set to 50,000 particles. The number of time of measurement is set to one time and, as Kd value, the value is set which has been obtained using "Standard Particles, 10.0 μm" (available from Beckman Coulter, Inc.). Threshold value and noise level are automatically set by pressing "Threshold Value/Noise Level Measuring Button". Then, current is set to 1,600 μA, gain to 2, and electrolytic solution to ISOTON II, where "Flash for Aperture Tube after Measurement" is checked.

On a "Setting of Conversion from Pulse to Particle Diameter" screen of the software for exclusive use, the bin distance is set to logarithmic particle diameter, the particle diameter bin to 256 particle diameter bins, and the particle diameter range to from 2 μm to 60 μm.

A specific way of measurement is as follows:

(1) About 200 ml of the aqueous electrolytic solution is put into a 250 ml round-bottomed beaker made of glass for exclusive use in Multisizer 3, and this is set on a sample stand, where stirring with a stirrer rod is carried out at 24 revolutions/second in the anticlockwise direction. Then, a "Flash of Aperture" function of the analytical software is operated to beforehand remove any dirt and air bubbles in the aperture tube.

(2) About 30 ml of the aqueous electrolytic solution is put into a 100 ml flat-bottomed beaker made of glass. To this water, about 0.3 ml of a dilute solution is added as a dispersant, which has been prepared by diluting "CONTAMINON N" (an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd.) with ion-exchanged water to 3-fold by mass.

(3) An ultrasonic dispersion machine of 120 W in electric output "Ultrasonic Dispersion system TETORA 150" (manufactured by Nikkaki Bios Co.) is readied, having two oscillators of 50 kHz in oscillation frequency which are built therein in the state their phases are shifted by 180 degrees. Into its water tank, about 3.3 liters of ion-exchanged water is put, and about 2 ml of CONTAMINON N is added to the water in this water tank.

(4) The beaker of the above (2) is set to a beaker fixing hole of the ultrasonic dispersion machine, and the ultrasonic dispersion machine is set working. Then, the height position of the beaker is so adjusted that the state of resonance of the aqueous electrolytic solution surface in the beaker may become highest.

(5) In the state the aqueous electrolytic solution in the beaker of the above (4) is irradiated with ultrasonic waves, about 10 mg of the toner is little by little added to the aqueous electrolytic solution and is dispersed therein. Then, such ultrasonic dispersion treatment is further continued for 60 seconds. In carrying out the ultrasonic dispersion treatment, the water temperature of the water tank is appropriately so controlled as to be 10° C. or more to 40° C. or less.

(6) To the round-bottomed beaker of the above (1), placed inside the sample stand, the aqueous electrolytic solution in which the toner has been dispersed in the above (5) is dropwise put in by using a pipette, and the measuring concentration is so adjusted as to be about 5%. Then the measurement is made until the measuring particles come to 50,000 particles in number.

(7) The data of measurement are analyzed by using the above software attached to the measuring instrument for its exclusive use, to calculate the weight average particle diameter (D4). Here, "Average Diameter" on an "Analysis/Volume Statistic Value (Arithmetic Mean)" screen when set to graph/% by volume in the software for exclusive use is the weight average particle diameter (D4).

Average Circularity of Toner:

The average circularity of the toner is measured with a flow type particle image analyzer "FPIA-3000 Model" (manufactured by Sysmex Corporation) on the basis of conditions of measurement and analysis made in operating corrections.

A specific way of measurement is as follows: First, about 20 ml of ion-exchanged water, from which impurity solid matter and the like have beforehand been removed, is put into a container made of glass. To this water, about 0.2 ml of a dilute solution is added as a dispersant, which has been prepared by diluting "CONTAMINON N" (an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd.) with ion-exchanged water to about 3-fold by mass. Further, about 0.02 g of a measuring sample is added, followed by dispersion treatment for 2 minutes by means of an ultrasonic dispersion machine to prepare a liquid dispersion for measurement. In that course, the dispersion system is appropriately so cooled that the liquid dispersion may have a temperature of 10° C. or more to 40° C. or less. As the ultrasonic dispersion machine, a desk-top ultrasonic washer dispersion machine of 50 kHz in oscillation frequency and 150 W in electric output (e.g., "VS-150", manufactured by Velvo-Clear Co.) is used. Into its water tank, a stated amount of ion-exchanged water is put, and about 2 ml of the above CONTAMINON N is fed into this water tank.

In the measurement, the flow type particle image analyzer is used, having as a standard objective lens "UPlanApro" (magnifications: 10 times; numerical aperture: 0.40), and Particle Sheath "PSE-900A" (available from Sysmex Corporation) is used as a sheath solution. The liquid dispersion having been controlled according to the above procedure is introduced into the flow type particle image analyzer, where 3,000 toner particles are counted in an HPE measuring mode and in a total count mode. Then, the binary-coded threshold value at the time of particle analysis is set to 85%, and the diameters of particles to be analyzed are limited to circle-equivalent diameters of from 1.985 μm or more to less than 39.69 μm, where the average circularity of toner particles is determined.

In measuring the circularity, before the measurement is started, autofocus control is performed using standard latex particles (e.g., "RESEARCH AND TEST PARTICLES Latex Microsphere Suspensions 5200A", available from Duke Scientific Corporation, diluted with ion-exchanged water). Thereafter, the autofocus control may preferably be performed at intervals of 2 hours after the measurement has been started.

In Examples of the present invention, a flow type particle image analyzer was used on which correction was operated by Sysmex Corporation and for which a correction certificate issued by Sysmex Corporation was issued. Measurement was made under the measurement and analysis conditions set when the correction certificate was received, except that the diameters of particles to be analyzed were limited to the circle-equivalent diameter of from 1.985 μm or more to less than 39.69 μm.

SEC-MALLS Measurement [Mn(135° C.)] of Toner:

The number-average molecular weight Mn(135° C.) is determined in the following way.

0.03 g of the toner is dispersed in 10 ml of o-dichlorobenzene, and these are shaken at 135° C. for 24 hours by means of a shaker, followed by filtration with a 0.2 μm filter. The filtrate thus obtained is used as a sample.

Analytical Conditions

Separating columns: Shodex (TSK GMHHR-H HT20)×2.
Column temperature: 135° C.
Mobile phase solvent: o-Dichlorobenzene.
Mobile phase flow rate: 1.0 ml/min.
Sample concentration: About 0.3%.
Injected: In an amount of 300 μl.
Detector 1: Multi-angle light scattering detector Wyatt DAWN EOS.
Detector 2: Differential reflective-index detector Shodex RI-71.
The data was analyzed by employing ASTRA for Windows 4.73.04 (Wyatt Technology Corp.).

SEC-MALLS Measurement [Mn(25° C.)] of Toner:

The number-average molecular weight Mn(25° C.) is determined in the same way as that for the Mn(135° C.) except that the following sample is used and analytical conditions are changed as shown below.

0.03 g of the toner is dispersed in 10 ml of tetrahydrofuran, and these are shaken at 25° C. for 24 hours by means of a shaker, followed by filtration with a 0.2 μm filter. The filtrate thus obtained is used as a sample.

Analytical Conditions

Separating columns: Shodex (SHODEX GPC-KF-804)×2.
Column temperature: 25° C.
Mobile phase solvent: Tetrahydrofuran.
Mobile phase flow rate: 1.0 ml/min.
Sample concentration: About 0.3%.
Injected: In an amount of 300 μl.
Detector 1: Multi-angle light scattering detector Wyatt DAWN EOS.
Detector 2: Differential reflective-index detector Shodex RI-71.
The data was analyzed by employing ASTRA for Windows 4.73.04 (Wyatt Technology Corp.).

SEC-MALLS Measurement [Square Radius of Inertia Rw(25° C.), Mw(25° C.)] of Toner:

The molecular size (square radius of inertia) and the weight-average molecular weight Mw(25° C.) are calculated from the values of R(θ) and C that are found when the Mw(25° C.) is measured.

The data was analyzed by employing ASTRA for Windows 4.73.04 (Wyatt Technology Corp.).

Measurement for Polyester Resin:

The molecular weight of THF-soluble matter of the polyester resin is measured in the following way by gel permeation chromatography (GPC).

First, the toner or the polyester resin is dissolved in tetrahydrofuran (THF) at room temperature over a period of 24 hours. Then, the solution obtained is filtered with a solvent-resistant membrane filter "MAISHORIDISK" (available from Tosoh Corporation) of 0.2 μm in pore diameter to make up a sample solution. Here, the sample solution is so controlled that the component soluble in THF is in a concentration of about 0.8% by mass. Using this sample solution, the measurement is made under the following conditions.

Instrument: HLC8120 GPC (detector: RI) (manufactured by Tosoh Corporation).

Columns: Combination of seven columns, Shodex KF-801, KF-802, KF-803, KF-804, KF-805, KF-806 and KF-807 (available from Showa Denko K.K.).

Eluent: Tetrahydrofuran (THF).

Flow rate: 1.0 ml/min.

Oven temperature: 40.0° C.

Amount of sample injected: 0.10 ml.

To calculate the molecular weight of the sample for measurement, a molecular weight calibration curve is used which is prepared using a standard polystyrene resin (e.g., trade name "TSK Standard Polystyrene F-850, F-450, F-288, F-128, F-80, F-40, F-20, F-10, F-4, F-2, F-1, A-5000, A-2500, A-1000, A-500"; available from Tosoh Corporation). In the molecular weight distribution found, the proportion of molecular weight of 500 calculated from the molecular weight calibration curve is calculated.

Measurement of Melting Point (Endothermic Peak Top) of Release Agent:

The endothermic peak top temperature of the release agent is measured according to ASTM D3418-82, using a differential scanning calorimetry analyzer "Q1000" (manufactured by TA Instruments Japan Ltd.).

The temperature at the detecting portion of the instrument is corrected on the basis of melting points of indium and zinc, and the amount of heat is corrected on the basis of heat of fusion of indium.

Stated specifically, about 10 mg the release agent is precisely weighed, and this is put into a pan made of aluminum and an empty pan made of aluminum is used as reference. Measurement is made at a heating rate of 10° C./min within the measurement temperature range of from 30° C. to 200° C. Here, in the measurement, the release agent is first heated to 200° C., then cooled to 30° C. and thereafter heated again. In the course of this second-time heating, a maximum endothermic peak of a DSC curve in the temperature range of from 30° C. to 200° C. is taken as the endothermic peak of the release agent in its DSC measurement.

Measurement of Acid Value of Release Agent:

The acid value of the release agent is measured according to JIS K1557-1970. A specific way of measurement is shown below.

First, 2 g the release agent is precisely weighed [W (g)]. The sample is put into a 200 ml Erlenmeyer flask, and 100 ml of a toluene/ethanol (2:1) mixed solvent is added thereto to dissolve the sample over a period of 5 hours. A phenolphthalein solution is added thereto as an indicator. Using a 0.1N KOH alcohol solution, the solution in the flask is titrated by using a burette. The amount of the KOH solution at this point is represented by S (ml). A blank test is conducted, and the amount of the KOH solution at this point is represented by B (ml).

The acid value is calculated according to the following expression.

$$\text{Acid value}=[(S-B)\times f\times 5.61]/W.$$

(f: the factor of KOH.)

Polymerization Conversion:

The polymerization conversion in the suspension polymerization is calculated by quantitative determination of a residual styrene monomer. More specifically, the time at which the total weight in the styrene monomer added has all been detected in the measurement shown below is regarded as polymerization conversion 0%, and the time at which the styrene monomer has no longer come to be detected as a result of progress of the polymerization reaction is regarded as polymerization conversion 100%.

The residual styrene monomer in the toner is quantitatively determined by gas chromatography (GC) to make measurement in the following way.

About 500 mg the toner is precisely weighed, and is put into a sample bottle. To this, about 10 g of acetone precisely weighed is added, and the bottle is covered up. Thereafter, its contents are well mixed, and the mixture obtained is irradiated with ultrasonic waves for 30 minutes by means of a desk-top ultrasonic washer of kHz in oscillation frequency and 125 W in electric output (e.g., "B2510J-MTH", trade name; manufactured by Branson Ltd.). Thereafter, the mixture thus treated is filtered with a solvent-resistant membrane filter "MAISHORIDISK" (available from Tosoh Corporation) of 0.2 μm in pore diameter, and then 2 μl of the filtrate is analyzed by gas chromatography. Then, the residue of the residual styrene monomer is calculated using a calibration curve beforehand prepared by using styrene.

A measuring instrument and measurement conditions are as follows:

GC: HP Co., 6890GC.

Column: HP Co., INNOWax (200 μm×0.40 μm×25 m).

Carrier gas: He (constant pressure mode: 20 psi).

Oven: (1) 50° C., held for 10 minutes, (2) heated to 200° C. at a rate of 10° C./minute, (3) held at 200° C. for 5 minutes.

Injection opening: 200° C., pulsed slip mode (20-40 psi, until 0.5 minute).

Split ratio: 5.0:1.0

Detector: 250° C. (FID).

Measurement of Tetrahydrofuran-Insoluble Matter:

About 1.5 g of the toner is weighed (W1 g), which is then put into a cylindrical filter paper (e.g., trade name: No. 86R, 28 mm×100 mm in size, available from Advantec Toyo, Co., Ltd.) weighed previously, and this is set on a Soxhlet extractor. Then, extraction is carried out for 10 hours using 200 ml of tetrahydrofuran (THF) as a solvent. At this point, the extraction is carried out at such a reflux speed that the extraction cycle of the solvent is one time per about 5 minutes.

After the extraction has been completed, the cylindrical filter paper is taken out and air-dried, and thereafter vacuum-dried at 40° C. for 8 hours to measure the mass of the cylindrical filter containing extraction residues, where the mass (W2 g) of the extraction residues is calculate by subtracting the mass of the cylindrical filter.

Next, the content (W3 g) of components other than the resin component is determined by the following procedure. About 2 g of the toner is weighed (Wa g) and put into a 30 ml magnetic crucible weighed previously. This crucible is put into an electric furnace, and is heated at about 900° C. for about 3 hours, followed by leaving to cool in the electric furnace, and then leaving to cool in a desiccator for 1 hour or more at normal temperature, where the mass of the crucible containing incineration residue ash content is weighed, and the incineration residue ash content (Wb g) is calculated by subtracting the mass of the crucible. Then, the incineration residue ash content (W3 g) in W1 g of the sample is calculated according to the following expression.

$$W3=W1\times(Wb/Wa).$$

In this case, the value of the tetrahydrofuran-insoluble matter is found according to the following expression.

$$\text{Tetrahydrofuran-insoluble matter (\% by mass)}=\{(W2-W3)/(W1-W3)\}\times 100.$$

Measurement of ODCM-Insoluble Matter:

The ODCM-insoluble matter is measured in the same way as the measurement of the tetrahydrofuran-insoluble matter except that o-dichlorobenzene (ODCB) is used and the conditions for the drying after extraction are changed to 20 hours at 60° C.

Measurement of Acetone-Insoluble Matter:

The acetone-insoluble matter is measured in the same way as the measurement of the tetrahydrofuran-insoluble matter except that acetone is used.

EXAMPLES

The present invention is described below in greater detail by giving Examples and Comparative Examples.

In the following, what are expressed as "part(s)" and "%" are by mass unless particularly noted.

Ester Wax

Those shown in Table 1 below were used as release agents ester waxes.

TABLE 1

| Ester wax | Type | Maximum endothermic peak temp. (° C.) |
|---|---|---|
| E1 | Behenyl behenate | 73 |
| E2 | Dibehenyl sebacate | 73 |
| E3 | Pentaerythritol tetrabehenate | 82 |

Hydrocarbon Wax

Those shown in Table 2 below were used as hydrocarbon waxes.

TABLE 2

| Hydro-carbon wax | Type | Maximum endothermic peak temp. (° C.) |
|---|---|---|
| P1 | Paraffin wax (HNP-9, available from Nippon Seiro Co., Ltd.) | 75 |
| P2 | Fischer-Tropsch wax (HNP-51, available from Nippon Seiro Co., Ltd.) | 77 |

Polymerization Initiator

Those shown in Table 3 below were used as polymerization initiators.

TABLE 3

| | Polymerization initiator | 10-hour half-life temp. (° C.) |
|---|---|---|
| PI1 | Di(2-ethylhexyl)peroxydicarbonate | 49 |
| PI2 | Di(secondary butyl)peroxydicarbonate | 51 |
| PI3 | Dibenzoyl peroxide | 73 |
| PI4 | t-Butyl peroxyneodecanoate | 48 |

Cross-Linking Agent

Those shown in Table 4 below were used as cross-linking agents.

TABLE 4

| Cross-linking agent | |
|---|---|
| R1 | 1,4-Butanediol diacrylate |
| R2 | 1,10-Decanediol diacrylate |
| R3 | 1,18-Octadecanediol diacrylate |
| R4 | Divinyl benzene |

Synthesis of Polyester Resin PE1

The following components were put into a reaction tank provided with a cooling tube, a stirrer and a nitrogen feed tube, and were allowed to react at 230° C. for 10 hours in a stream of nitrogen while removing the water being formed.

| | |
|---|---|
| Bisphenol-A propylene oxide 2-mole addition product | 80 parts |
| Bisphenol-A propylene oxide 3-mole addition product | 20 parts |
| Terephthalic acid | 100 parts |
| Titanium type catalyst (titanium dihydroxybis(triethanol aminate) | 0.25 part |

Next, these were allowed to react under reduced pressure of 5 to 20 mmHg. At a point of time where the reaction product came to have an acid value of 2 mgKOH/g or less, this was cooled to 180° C., and 10 parts of trimellitic anhydride was added thereto. After the reaction was carried out for 2 hours under normal pressure in a closed system, the reaction product obtained was taken out and then cooled to room temperature, followed by pulverization to obtain a polyester resin PE1. The polyester resin PE1 obtained had an Mw of 10,500, an Mn of 3,800 and an acid value of 6 mgKOH/g.

| Synthesis of Polyester Resin PE2 | |
|---|---|
| Bisphenol-A propylene oxide 2-mole addition product | 60 parts |
| Bisphenol-A propylene oxide 3-mole addition product | 40 parts |
| Terephthalic acid | 100 parts |
| Antimony type catalyst (antimony trioxide) | 2 parts |

A polyester resin PE2 was obtained in the same way as Synthesis of Polyester Resin PE1 except that materials were changed as formulated above. The polyester resin PE2 obtained had an Mw of 10,300, an Mn of 4,000 and an acid value of 7 mgKOH/g.

| Synthesis of Styrene-Acrylate Copolymer 1 | |
|---|---|
| Styrene | 75.0 parts |
| n-Butyl acrylate | 25.0 parts |
| Polymerization initiator RI 1 | 0.5 part |
| Cross-linking agent R1 | 0.8 part |

The above raw materials were dropwise added to 200 parts of xylene heated during 4 hours. Further, under reflux of xylene, the polymerization was completed to obtain a styrene-acrylate copolymer 1. The styrene-acrylate copolymer 1 obtained was, as a result of the measurement of its molecular weight by SEC-MALLS, found to have an Mn(25° C.) of 2,500 and a value of Mn(135° C.)/Mn(25° C.) of 30. It also had a glass transition temperature (Tg) of 60° C.

Production Example of Magnetic Iron Oxide M1

In an aqueous ferrous sulfate solution, a sodium hydroxide solution (containing 1% by mass of sodium hexametaphosphate in terms of P based on Fe) was mixed in an equivalent weight of 1.0 based on iron ions, to prepare an aqueous solution which contained ferrous hydroxide. Maintaining the pH of the aqueous solution at 9, air was blown into it to effect oxidation reaction at 80° C. to prepare a slurry fluid from which seed crystals were to be formed.

Next, to this slurry fluid, an aqueous ferrous sulfate solution was so added as to be in an equivalent weight of 1.0 based on the initial alkali content (the sodium component in the sodium hydroxide). Then, maintaining the pH of the slurry fluid at 8, oxidation reaction was carried on while air was blown into it.

After the oxidation reaction was completed, the slurry obtained was filtered and then re-slurried with pure water, followed by filtration made again. Such re-slurrying and filtration were repeated five times. Thus, impurities on magnetic material particle surfaces were removed.

Next, the product obtained was re-slurried with pure water, and then the pH of the re-slurry obtained was adjusted to about 6. As a silane coupling agent, n-$C_6H_{13}Si(OCH_3)_3$ was added thereto in an amount of 1.5 parts based on 100 parts of the magnetic iron oxide, followed by thorough stirring. The hydrophobic iron oxide particles thus formed were washed, filtered and then dried by conventional methods. Particles standing agglomerate were disintegration-treated, followed by heat treatment at a temperature of 70° C. for 5 hours to obtain a magnetic iron oxide M1.

The magnetic iron oxide M1 had a number average particle diameter (Dv) of 0.25 μm, and was 67.3 $Am^2/kg$ (emu/g) and 4.0 $Am^2/kg$ (emu/g) in saturation magnetization and residual magnetization, respectively, in a magnetic field of 79.6 kA/m (1,000 oersteds).

Production Example of Magnetic Iron Oxide M2

In an aqueous ferrous sulfate solution, a sodium hydroxide solution (containing 1% by mass of sodium hexametaphosphate in terms of P based on Fe) was mixed in an equivalent weight of 1.0 based on iron ions, to prepare an aqueous solution which contained ferrous hydroxide. Maintaining the pH of the aqueous solution at 9, air was blown into it to effect oxidation reaction at 80° C. to prepare a slurry fluid from which seed crystals were to be formed.

Next, to this slurry fluid, an aqueous ferrous sulfate solution was so added as to be in an equivalent weight of 1.0 based on the initial alkali content (the sodium component in the sodium hydroxide). Then, maintaining the pH of the slurry fluid at 8, oxidation reaction was carried on while air was blown into it, and the pH of the slurry fluid was adjusted to about 6 at late stage. To the slurry of magnetic iron oxide obtained, as a silane coupling agent, n-$C_6H_{13}Si(OCH_3)_3$ was added in an amount of 1.5 parts based on 100 parts of the magnetic iron oxide, followed by thorough stirring. The hydrophobic iron oxide particles thus formed were washed, filtered and then dried by conventional methods. Particles standing agglomerate were disintegration-treated, followed by heat treatment at a temperature of 70° C. for 5 hours to obtain a magnetic iron oxide M2.

The magnetic iron oxide M2 had a number average particle diameter (Dv) of 0.25 μm, and was 67.3 $Am^2/kg$ (emu/g) and 4.0 $Am^2/kg$ (emu/g) in saturation magnetization and residual magnetization, respectively, in a magnetic field of 79.6 kA/m (1,000 oersteds).

Production of Toner 1

Into 720 parts of ion-exchanged water, 450 parts of an aqueous 0.1 mol/liter $Na_3PO_4$ solution was introduced, and these were heated to a temperature of 60° C. Thereafter, 67.7 parts of an aqueous 1.0 mol/liter $CaCl_2$ solution was added thereto to obtain an aqueous medium containing a dispersion stabilizer.

| | |
|---|---|
| Styrene | 75 parts |
| n-Butyl acrylate | 25 parts |
| Cross-linking agent R2 | 0.8 part |
| Polyester resin PE1 | 5 parts |
| Negative charge control agent (T-77, available from Hodogaya Chemical Co., Ltd.) | 1 part |
| Magnetic iron oxide M1 (colorant) | 90 parts |

Materials formulated as above were uniformly dispersed and mixed by means of an attritor (manufactured by Mitsui Miike Engineering Corporation) to obtain a monomer composition. This monomer composition was heated to a temperature of 60° C., and 10 parts of the ester wax E2 and 5 parts of the hydro-carbon wax P1 as the release agent a and the release agent b, respectively, and also 4 parts of the polymerization initiator PI2 (10-hour half-life temperature: 51° C.) were mixed thereinto to dissolve these to prepare a polymerizable monomer composition.

The polymerizable monomer composition was introduced into the above aqueous medium, followed by stirring for 15 minutes at a temperature of 60° C. in an atmosphere of $N_2$ and at 10,000 rpm using TK type homomixer (manufactured by Tokushu Kika Kogyo Co., Ltd.), to carry out granulation.

Thereafter, the granulated product obtained was stirred with a paddle stirring blade, and the reaction was carried out at a temperature of 70° C. (temperature higher by 19° C. than the 10-hour half-life temperature of R1). At the time the polymerization conversion was 90%, the polymerization initiator PI2 was further additionally added in an amount of 2 parts, where the reaction was further continued for 5 hours.

After the reaction was completed, the suspension formed was cooled, and hydrochloric acid was added thereto to dissolve the dispersant, followed by filtration, water washing and then drying to obtain toner particles 1.

100 parts of the toner particles 1 (toner base particles) obtained and 1.0 part of hydrophobic fine silica powder 1 which was obtained by treating a silica base of 12 nm in number average primary particle diameter with hexamethyldisilazane and had a BET specific surface area of 120 $m^2/g$ after the treatment were mixed by means of Henschel mixer (manufactured by Mitsui Miike Engineering Corporation) to obtain a toner 1. Physical properties of the toner 1 are shown in Table 5.

Production of Toners 2 to 25

Toners 2 to 25 were obtained in the same way as Production of Toner 1 except that the types and amounts of the release agent, polyester resin, cross-linking agent, colorant and polymerization initiator and the type and amount of the polymerization initiator to be additionally added were changed as shown in Table 5. Physical properties of the toners 2 to 25 are shown in Table 5. Incidentally, the polymerization initiator is additionally added in the reaction step. It is seen that the additional addition of the polymerization initiator has enabled control of the value of Mn(135° C.)/Mn(25° C.) as desired.

| Production of Toner 26 | |
|---|---|
| Styrene-acrylate copolymer 1 | 100 parts |
| Magnetic iron oxide 2 (colorant) | 90 parts |
| Monoazo iron complex (T-77, available from Hodogaya Chemical Co., Ltd.) | 2 parts |
| Ester wax 1 (release agent) | 4 parts |

The above mixing materials were premixed by means of Henschel mixer, and thereafter melt-kneaded by means of a twin-screw extruder heated to 110° C., to obtain a kneaded product, which was then cooled and the kneaded product cooled was crushed by using a hammer mill to obtain a crushed product for toner. The crushed product obtained was finely pulverized by means of a mechanical grinding machine Turbo mill (manufactured by Turbo Kogyo Co., Ltd.; the surfaces of its rotator and stator were coated by plating of a chromium alloy containing chromium carbide; plating thickness: 150 μm; surface hardness: HV 1,050). The finely pulverized product thus obtained was classified by means of a multi-division classifier utilizing the Coanda effect (Elbow Jet Classifier, manufactured by Nittetsu Mining Co., Ltd.) to classify and remove fine powder and coarse powder simultaneously.

The raw-material toner particles obtained were subjected to surface modification and removal of fine particles by means of a surface modifying apparatus FACULTY (manufactured by Hosokawa Micron Corporation) to obtain toner particles 26. In that course, its dispersing rotor was set at a rotational peripheral speed of 150 m/sec, the finely pulverized product was fed at a rate of 7.6 kg per cycle, and its surface modification time (i.e., cycle time, which is the time after raw-material feed has been completed and before the discharge valve is opened) was set to 82 seconds. The temperature at the time the toner particles were discharged was 44° C.

To the toner particles 26 (toner base particles) obtained, the hydrophobic fine silica powder 1 was externally added in the same way as that in Production of Toner 1 to obtain a toner 26, having a weight-average particle diameter (D4) of 6.5 μm. Physical properties of the toner 26 are shown in Table 5.

Production of Toner 27

Into 780 parts of ion-exchanged water, 440 parts of an aqueous 0.1 mol/liter $Na_3PO_4$ solution was introduced, and these were heated to a temperature of 60° C. Thereafter, 65 parts of an aqueous 1.0 mol/liter $CaCl_2$ solution was added thereto to obtain an aqueous medium containing a dispersion stabilizer.

| | |
|---|---|
| Styrene | 80 parts |
| n-Butyl acrylate | 20 parts |
| Cross-linking agent R2 | 0.8 part |
| Polyester resin (peak molecular weight Mp: 7,300; hydroxyl value OHV: 16 mgKOH/g) | 5 parts |
| Monoazo iron complex (T-77, available from Hodogaya Chemical Co., Ltd.) | 1 part |
| Magnetic iron oxide M2 | 90 parts |
| Ester wax (maximum endothermic peak temperature: 59° C.) | 10 parts |

Materials formulated as above were heated to a temperature of 60° C., and then uniformly dispersed and dissolved at 12,000 rpm by means of a TK-type homomixer (manufactured by Tokushu Kika Kogyo Co., Ltd.). Into the solution obtained, 7 parts of the polymerization initiator PI2 was introduced and dissolved to prepare a polymerizable monomer system.

This polymerizable monomer system was introduced into the above aqueous medium, and these were stirred at 10,000 rpm for 15 minutes by means of the TK-type homomixer at a temperature of 60° C. in an atmosphere of $N_2$ to effect granulation. Thereafter, with stirring by using a paddle stirring blade, the reaction was carried out at 60° C. for 7 hours, and thereafter the temperature was raised to 80° C., where the reaction was further carried out for 3 hours.

After the reaction was completed, the suspension formed was cooled, and hydrochloric acid was added thereto to dissolve the dispersant at a pH of 2 or less, followed by filtration, water washing and then drying to obtain toner particles 27.

To the toner particles 27 (toner base particles) obtained, the hydrophobic fine silica powder 1 was externally added in the same way as that in Production of Toner 1 to obtain a toner 27, having a weight-average particle diameter (D4) of 7.3 μm. Physical properties of the toner 27 are shown in Table 5.

Production of Toner 28

(1) Preparation of Release Agent Dispersion:

90 parts of styrene and 10 parts of a release agent (trade name: "Paraffin Wax 155", available from Nippon Seiro Co., Ltd.; melting point: 70° C.) were introduced into a media type grinding mill to carry out wet-process pulverization to prepare a liquid dispersion in which the release agent stood dispersed uniformly in the styrene. The release agent in this liquid dispersion had a 50% volume-average particle diameter (D50) of 2.8 μm and a 90% volume-average particle diameter (D90) of 6.8 μm. To measure the volume-average particle diameter (D50), a sample was added to styrene and was dispersed therein under application of ultrasonic waves to make up a liquid dispersion, and then the liquid dispersion was dropwise put into a measuring cell filled with styrene, to make measurement with SALD-2000J (manufactured by Shimadzu Corporation).

(2) Preparation of Polymerizable Monomer Composition:

40 parts of the release agent dispersion prepared in the step (1) (containing 36 parts of the styrene and 4 parts of the release agent), 47 parts of styrene, 17 parts of n-butyl acrylate, 90 parts of the magnetic iron oxide 2, 0.3 part of divinylbenzene and 1.0 part of t-dodecyl mercaptan were stirred and mixed by means of a conventional stirring machine, and thereafter introduced into a media type dispersion machine to carry out uniform dispersion to obtain a polymerizable monomer composition.

(3) Preparation of Slightly Water-Soluble Metal Oxide Colloidal Dispersion:

To an aqueous solution prepared by dissolving 10.2 parts of magnesium chloride in 250 parts of ion-exchanged water, an aqueous solution prepared by dissolving 6.2 parts of sodium hydroxide in 50 parts of ion-exchanged water was slowly added with stirring to prepare a magnesium hydroxide colloidal dispersion. The particle size distribution of magnesium hydroxide colloids formed was measured with a microtrack particle size measuring instrument (manufactured by Nikkiso Co. Ltd.) to find that their 50% volume-average particle diameter (D50) was 0.37 μm, and 90% volume-average particle diameter (D90), 0.81 μm. The measurement with the microtrack particle size measuring instrument was made under conditions of measurement range: from 0.12 μm to 704 μm, measurement time: 30 seconds, and medium: ion-exchanged water.

(4) Production of Colored Polymer Particles:

The polymerizable monomer composition prepared in the step (2) was introduced into the magnesium hydroxide colloidal dispersion prepared in the step (3), and these were stirred until their droplets became stable, followed by addition of 4 parts of the polymerization initiator PI4, an oil-soluble polymerization initiator. These were stirred under high shear at a number of revolutions of 12,000 using a TK type homomixer to granulate the polymerizable monomer composition into fine droplets. The particle diameter of the fine droplets obtained was measured with SALD-2000J (manufactured by Shimadzu Corporation) to find that their 50% volume-average particle diameter (D50) was 6.1 μm. An aqueous dispersion containing the droplets of this polymerizable monomer composition was put into a reaction vessel fitted with a stirring blade, and then heated to 60° C. to initiate the polymerization reaction. At the time the polymerization conversion became 80%, an aqueous solution prepared by dissolving 5 parts of a water-soluble polymerization initiator ammonium persulfate in 65 parts of distilled water was fed into the reaction vessel. Next, the polymerization reaction was continued for 8 hours, and thereafter the reaction was stopped to obtain an aqueous dispersion of pH 9.5, containing colored polymer particles having been formed. The colored polymer particles were taken out, and their volume-average particle diameter (Dv) was measured to find that it was 7.0 μm, the value of volume-average particle diameter (Dv)/number-average particle diameter (Dp) was 1.33 and the value found by dividing length of toner particles by breadth thereof, rl/rs, was 1.16.

(5) Collection of Colored Polymer Particles:

With stirring the aqueous dispersion obtained in the step (4), hydrochloric acid was added to adjust the pH of the aqueous dispersion obtained to about 5.5 and acid washing (25° C., 10 minutes) was carried out, subsequently followed by filtration and dehydration, where, after the dehydration, washing water was sprayed to carry out water washing. The solid matter obtained was separated by filtration, and the solid matter separated was dried at 45° C. for 2 days in a drier to collect toner particles 28.

(6) Preparation of Developer:

To 100 parts of the toner particles 28 (toner base particles) obtained in the step (5), 0.8 part of silica having been hydrophobic-treated and having an average particle diameter of 12 nm (trade name: R202, available from Aerosil Japan, Ltd.) was externally added, and these were mixed by means of Henschel mixer to produce a toner 28. Physical properties of the toner 28 are shown in Table 5.

TABLE 5

| | Release agent | | | Cross-linking | Magnetic iron | Polymerization initiator | | | |
|---|---|---|---|---|---|---|---|---|---|
| | | | | | | In dissoln | Polymerzn | Added | Reaction |
| | a (pbm) | b (pbm) | Polyester (pbm) | agent (pbm) | oxide (pbm) | step (pbm) | conv. *1(%) | additnally (pbm) | tmp. (° C.) |
| | Toner: *1: when added additionally | | | | | | | | |
| 1 | E2(10) | P1(5) | PE1(5) | R2(0.8) | M1(90) | PI2(4) | 90 | PI2(2) | 70 |
| 2 | E2(10) | P1(5) | PE1(5) | R2(0.8) | M2(90) | PI2(4) | 90 | PI2(2) | 70 |
| 3 | E2(10) | P1(5) | PE1(5) | R2(0.5) | M2(90) | PI2(4) | 90 | PI2(2) | 70 |
| 4 | E2(10) | P1(5) | PE1(5) | R2(1.0) | M2(90) | PI2(4) | 90 | PI2(2) | 70 |
| 5 | E2(10) | P1(5) | PE1(5) | R3(0.8) | M2(90) | PI2(4) | 90 | P12(2) | 70 |
| 6 | E2(10) | P1(5) | PE1(5) | R1(0.8) | M2(90) | PI2(4) | 90 | PI2(2) | 70 |
| 7 | E2(10) | P1(5) | PE1(5) | R2(0.4) | M2(90) | PI2(4) | 90 | PI2(2) | 70 |
| 8 | E2(10) | P1(5) | PE1(5) | R2(1.1) | M2(90) | PI2(4) | 90 | PI2(2) | 70 |
| 9 | E2(10) | P1(5) | PE1(5) | R3(0.5) | M2(90) | PI2(4) | 90 | PI2(2) | 70 |
| 10 | E2(10) | P1(5) | PE1(5) | R1(0.8) | M2(90) | PI1(5) | 90 | PI1(2) | 68 |
| 11 | E1(10) | P2(5) | PE1(5) | R1(0.8) | M2(90) | PI1(5) | 90 | PI1(2) | 68 |
| 12 | E1(10) | P2(5) | PE2(5) | R1(0.8) | M2(90) | PI1(5) | 90 | PI1(2) | 68 |
| 13 | E3(10) | P2(5) | PE2(5) | R1(0.8) | M2(90) | PI1(5) | 90 | PI1(2) | 68 |
| 14 | E1(15) | — | PE2(5) | R1(0.8) | M2(90) | PI1(5) | 90 | PI1(2) | 68 |
| 15 | — | P2(5) | PE2(5) | R1(0.8) | M2(90) | PI1(5) | 90 | PI1(2) | 68 |
| 16 | E1(15) | — | PE2(5) | R1(0.8) | M2(90) | PI3(6) | 90 | PI3(3) | 90 |
| 17 | E1(15) | P2(5) | PE2(5) | R1(0.8) | M2(90) | PI3(4) | 90 | PI3(2) | 90 |
| 18 | E1(15) | P2(5) | PE2(5) | R1(0.8) | M2(90) | PI3(10) | 90 | PI3(4) | 90 |
| 19 | E1(15) | P2(5) | PE2(5) | R1(0.8) | M2(90) | PI3(6) | 90 | PI3(4) | 90 |
| 20 | E1(15) | P2(5) | PE2(5) | R1(0.8) | M2(90) | PI3(6) | 90 | PI3(1) | 90 |
| 21 | E1(15) | P2(5) | PE2(5) | R1(0.8) | M2(90) | PI3(6) | 90 | PI3(3) | 90 |
| 22 | E1(15) | P2(5) | PE2(5) | R1(0.8) | M2(90) | PI3(6) | — | — | 90 |
| 23 | E1(15) | P2(5) | PE2(5) | R1(0.8) | M2(90) | PI3(6) | 50 | PI3(1) | 90 |

TABLE 5-continued

| | | | | | | | | | |
|---|---|---|---|---|---|---|---|---|---|
| 24 | E1(15) | P2(5) | PE2(5) | R1(0.8) | M2(90) | PI3(3) | 90 | PI3(2) | 90 |
| 25 | E1(15) | P2(5) | PE2(5) | R1(0.8) | M2(90) | PI3(12) | 90 | PI3(3) | 90 |
| 26 | Formulation and production conditions are described in specification. | | | | | | | | |
| 27 | EW(10) | P2(5) | PE*(2) | R1(0.8) | M2(90) | PI2(7) | — | — | 60 |
| 28 | — | PW(10) | — | R4(0.3) | M2(90) | PI4(4) | 80 | APS(5) | 60 |

| | D4 (μm) | Av. circularity | Mn 25° C. (A) | Mn 135° C. (B) | B/A | Rw 25° C./ Mn 25° C. | Go (%) | Gt (%) | Ga-Gt (%) |
|---|---|---|---|---|---|---|---|---|---|
| 1 | 6.5 | 0.973 | 1,500 | 60,000 | 40 | $1 \times 10^{-2}$ | 5 | 20 | 10 |
| 2 | 6.5 | 0.972 | 2,000 | 70,000 | 35 | $5 \times 10^{-3}$ | 15 | 25 | 15 |
| 3 | 6.5 | 0.971 | 2,000 | 64,000 | 32 | $7 \times 10^{-3}$ | 3 | 5 | 15 |
| 4 | 6.6 | 0.970 | 2,000 | 80,000 | 40 | $3 \times 10^{-3}$ | 28 | 40 | 15 |
| 5 | 6.5 | 0.972 | 2,000 | 80,000 | 40 | $6 \times 10^{-3}$ | 10 | 20 | 5 |
| 6 | 6.4 | 0.969 | 2,200 | 79,200 | 36 | $4 \times 10^{-3}$ | 30 | 35 | 25 |
| 7 | 6.5 | 0.972 | 1,900 | 60,800 | 32 | $8 \times 10^{-3}$ | 2 | 4 | 12 |
| 8 | 6.4 | 0.970 | 2,000 | 80,000 | 40 | $2 \times 10^{-3}$ | 32 | 42 | 18 |
| 9 | 6.6 | 0.973 | 1,900 | 72,200 | 38 | $7 \times 10^{-3}$ | 2 | 4 | 3 |
| 10 | 6.5 | 0.972 | 1,000 | 35,000 | 35 | $1 \times 10^{-3}$ | 35 | 42 | 27 |
| 11 | 6.5 | 0.971 | 1,000 | 35,000 | 35 | $1 \times 10^{-3}$ | 35 | 42 | 27 |
| 12 | 6.4 | 0.970 | 1,000 | 35,000 | 35 | $1 \times 10^{-3}$ | 35 | 42 | 27 |
| 13 | 6.7 | 0.968 | 1,000 | 35,000 | 35 | $1 \times 10^{-3}$ | 35 | 42 | 27 |
| 14 | 6.6 | 0.972 | 1,000 | 35,000 | 35 | $1 \times 10^{-3}$ | 35 | 42 | 27 |
| 15 | 6.5 | 0.970 | 1,000 | 35,000 | 35 | $1 \times 10^{-3}$ | 35 | 42 | 27 |
| 16 | 6.6 | 0.969 | 2,500 | 75,000 | 30 | $3 \times 10^{-4}$ | 38 | 42 | 33 |
| 17 | 6.4 | 0.968 | 3,000 | 84,000 | 28 | $2 \times 10^{-4}$ | 40 | 46 | 35 |
| 18 | 6.5 | 0.968 | 500 | 13,000 | 26 | $5 \times 10^{-4}$ | 35 | 42 | 28 |
| 19 | 6.5 | 0.970 | 2,500 | 62,500 | 25 | $4 \times 10^{-4}$ | 38 | 43 | 32 |
| 20 | 6.4 | 0.968 | 2,500 | 125,000 | 50 | $2 \times 10^{-4}$ | 35 | 46 | 35 |
| 21 | 6.6 | 0.960 | 2,500 | 75,000 | 30 | $3 \times 10^{-4}$ | 34 | 44 | 33 |
| 22 | 6.6 | 0.969 | 2,500 | 57,500 | 23 | $9 \times 10^{-5}$ | 40 | 48 | 35 |
| 23 | 6.7 | 0.967 | 2,500 | 137,500 | 55 | $1 \times 10^{-5}$ | 35 | 48 | 35 |
| 24 | 6.5 | 0.968 | 3,300 | 92,400 | 28 | $5 \times 10^{-5}$ | 40 | 47 | 36 |
| 25 | 6.5 | 0.969 | 400 | 10,400 | 26 | $8 \times 10^{-4}$ | 32 | 41 | 26 |
| 26 | 6.5 | 0.955 | 2,500 | 75,000 | 30 | $3 \times 10^{-3}$ | 30 | 39 | 25 |
| 27 | 7.3 | 0.970 | 400 | 8,000 | 20 | $3 \times 10^{-3}$ | 0 | 0 | 0 |
| 28 | 7.0 | 0.965 | 5,000 | 100,000 | 20 | $1 \times 10^{-4}$ | 5 | 10 | 30 |

EW: ester wax, m.p.59° C.;
PE*: polyester, Mp 7,300, OHV 16;
PW: Paraffin Wax 155;
APS: ammonium persulfate

Example 1

As an image forming apparatus, a laser beam printer LBP-3100 (manufactured by CANON INC.) was used which was so converted as to have a process speed of 125 mm/sec.

In a normal-temperature and normal-humidity environment (temperature 25° C., humidity 50% RH), the toner 1 was used, and images made to have a print percentage of 1% using letters "A" of 8-point in size were printed on 4,000 sheets in an intermittent mode. As recording mediums, sheets of A4-size paper of 80 g/m$^2$ in basis weight were used.

The image forming apparatus was further so converted that the fixing temperature of its fixing unit was controllable, to make evaluation of low-temperature fixing performance as described later.

a) Image Density:

At the initial stage of printing and after printing on 4,000 sheets, solid images were formed to make evaluation. As image density, the relative density with respect to an image printed on a white background area with an image density of 0.00 of an original was measured with "MACBETH Reflection Densitometer" (manufactured by Gretag Macbeth Ag.) to make evaluation according to the following criteria.

A: 1.50 or more.

B: 1.40 or more to less than 1.50.

C, 1.30 or more to less than 1.40.

D: Less than 1.30.

b) Density Non-Uniformity:

At the initial stage of printing and after printing on 4,000 sheets, monochrome solid images and halftone images were printed on F90 sheets (letter-size FOX RIVER BOND 90 g/m$^2$ paper) and V37 sheets (A4-size VIEW CORONA S 37 g/m$^2$ paper), and their image uniformity was visually evaluated according to the following criteria.

A: Very good (uniform images and at a level where any density non-uniformity is not seen).

B: Good (density non-uniformity is somewhat seen, but at a level of no problem at all in practical use).

C: Tolerable in practical use (density non-uniformity is seen, but at a level tolerable in practical use).

Figure 3:
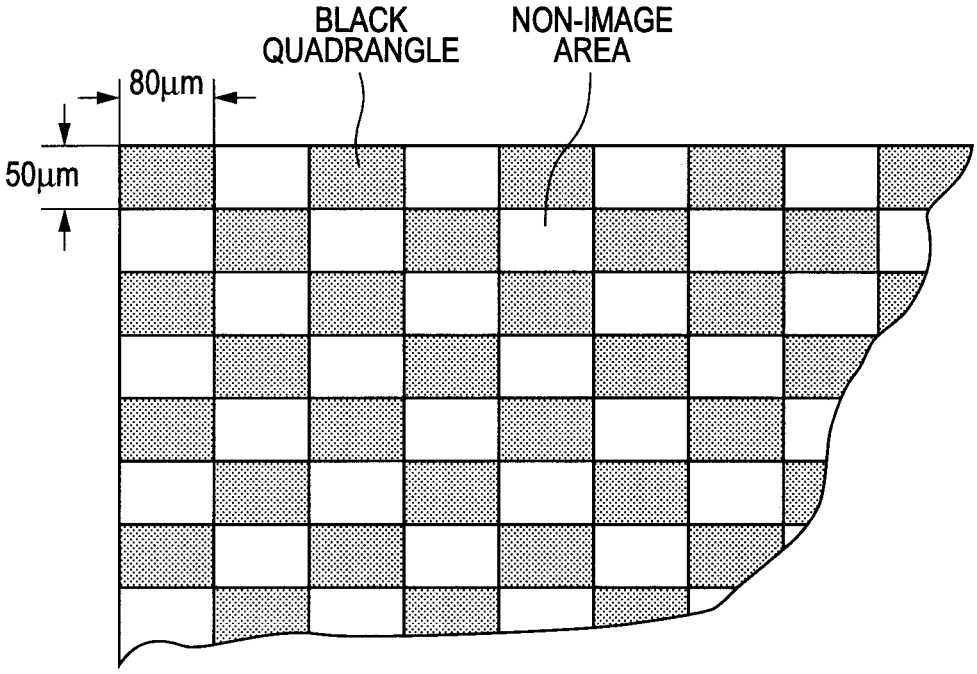
FIG. 3 is a checkered pattern image used in evaluating dot reproducibility.

D: Poor (density non-uniformity is conspicuous).

c) Dot Reproducibility:

At the initial stage of printing and after printing on 4,000 sheets, image reproduction was tested using a 80 μm×50 μm black and white checkered pattern shown in FIG. 3, and whether or not any defects were seen in its black quadrangle areas was observed on a microscope to make evaluation according to the following criteria.

A: Two or less defect(s) in 100 black quadrangles.

B: Three or more to five or less defects in 100 black quadrangles.

C: Six or more to ten or less defects in 100 black quadrangles.

D: Eleven or more defects in 100 black quadrangles.

d) Fixing Film Stains:

Whether or not any residual toner stood sticking to the surface of a fixing film after printing on 4,000 sheets was visually examined, and solid images as well, to make evaluation according to the following criteria.

A: Any stain does not occur.

B: Stains occur slightly.

C: Stains occur, but at a level tolerable in practical use.

D: Stains occur seriously.

e) Low-Temperature Fixing Performance:

Unfixed images were so controlled as to be formed in a toner laid-on level of 0.6 mg/cm$^2$, and thereafter fixed at fixing temperatures set at intervals of temperature 5° C. in the temperature range of from 160° C. or more to 230° C. or less to reproduce solid images of 5 cm square at 9 spots in an A4-sheet (XEROX 75 g/m$^2$ paper). The solid images formed were back and forth rubbed five times with Silbon paper to which a load of 4.9 kPa was kept applied, and the fixing temperature at which the rate of decrease in density of the fixed images came to 15% or more was regarded as fixing lower-limit temperature to make evaluation according to the following criteria.

A: The fixing lower-limit temperature is less than 180° C.

B: The fixing lower-limit temperature is 180° C. or more to less than 190° C.

C: The fixing lower-limit temperature is 190° C. or more to less than 200° C.

D: The fixing lower-limit temperature is 200° C. or more.

Examples 2 to 21

Using the toners 2 to 21 as toners, developing running performance and fixing performance were evaluated under the same conditions as those in Example 1. The results of evaluation are shown in Table 6.

TABLE 6

| | | In normal-temperature and normal-humidity environment (25° C., 50% RH) | | | | | | | | | |
|---|---|---|---|---|---|---|---|---|---|---|---|
| | | Image density | | Dot reproducibility | | Density non-uniformity (F90 paper) | | Density non-uniformity (V37 paper) | | Fixing film stains | |
| Example: | Toner | Initial stage | After 4,000 sheets | Initial stage | After 4,000 sheets | Initial stage | After 4,000 sheets | Initial stage | After 4,000 sheets | After 4,000 sheets | Fixing temp. |
| 1 | 1 | A | A | A | A | A | A | A | A | A | A |
| 2 | 2 | A | A | A | A | A | B | A | A | A | A |
| 3 | 3 | A | A | A | A | A | A | A | B | A | A |
| 4 | 4 | A | A | A | A | B | B | A | A | A | A |
| 5 | 5 | A | A | A | B | A | A | A | B | A | A |
| 6 | 6 | A | A | A | A | A | B | A | B | B | A |
| 7 | 7 | A | A | A | B | A | B | A | B | B | A |
| 8 | 8 | A | A | A | A | B | B | A | B | B | B |
| 9 | 9 | A | B | A | B | A | B | B | B | B | A |
| 10 | 10 | A | A | A | B | B | B | B | B | B | A |
| 11 | 11 | A | A | A | B | B | B | B | B | B | B |
| 12 | 12 | A | B | B | B | B | B | B | B | B | B |
| 13 | 13 | A | B | B | B | B | C | B | B | B | B |
| 14 | 14 | A | B | B | B | B | B | B | C | B | B |
| 15 | 15 | A | B | B | B | B | C | B | B | C | B |
| 16 | 16 | A | B | B | B | B | C | B | C | C | C |
| 17 | 17 | A | B | B | B | C | C | B | C | C | C |
| 18 | 18 | B | C | B | C | B | C | B | C | C | B |
| 19 | 19 | B | B | B | C | C | C | B | C | C | C |
| 20 | 20 | A | B | C | C | C | C | C | C | C | C |
| 21 | 21 | B | C | C | c | B | C | C | C | C | C |

Comparative Examples 1 to 7

Using the toners 22 to 28 as toners, developing running performance and fixing performance were evaluated under the same conditions as those in Example 1. The results of evaluation are shown in Table 7.

TABLE 7

| | | In normal-temperature and normal-humidity environment (25° C., 50% RH) | | | | | | | | | |
|---|---|---|---|---|---|---|---|---|---|---|---|
| | | Image density | | Dot reproducibility | | Density non-uniformity (F90 paper) | | Density non-uniformity (V37 paper) | | Fixing film stains | |
| Comparative Example: | Toner | Initial stage | After 4,000 sheets | Initial stage | After 4,000 sheets | Initial stage | After 4,000 sheets | Initial stage | After 4,000 sheets | After 4,000 sheets | Fixing temp. |
| 1 | 22 | B | B | B | C | C | C | C | D | C | C |
| 2 | 23 | B | B | B | C | C | D | C | C | D | D |
| 3 | 24 | B | B | C | D | C | D | C | C | D | D |
| 4 | 25 | B | C | C | C | B | D | D | D | D | B |
| 5 | 26 | B | D | C | D | C | D | C | D | D | C |

TABLE 7-continued

| | | In normal-temperature and normal-humidity environment (25° C., 50% RH) | | | | | | | | | |
|---|---|---|---|---|---|---|---|---|---|---|---|
| | | Image density | | Dot reproducibility | | Density non-uniformity (F90 paper) | | Density non-uniformity (V37 paper) | | Fixing film stains | |
| Comparative Example: | Toner | Initial stage | After 4,000 sheets | Initial stage | After 4,000 sheets | Initial stage | After 4,000 sheets | Initial stage | After 4,000 sheets | After 4,000 sheets | Fixing temp. |
| 6 | 27 | B | D | B | C | C | C | C | D | D | B |
| 7 | 28 | B | C | C | D | D | D | C | C | D | D |

What reference numerals denote:

100, photosensitive drum; 102, developing sleeve (toner carrying member); 103, elastic blade; 104, magnet roller; 114, transfer charging roller; 116, cleaner; 117, primary charging roller; 121, laser generator; 123, laser light; 124, registration roller; 125, transport belt; 126, fixing assembly; 140, developing assembly; 141, toner coating roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-137022, filed Jun. 16, 2010, which is hereby incorporated by reference herein in its entirety.

What is claimed is:

1. A toner comprising toner particles, each of the toner particles comprises a toner base particle containing a binder resin, a colorant and a release agent, and an inorganic fine powder;

wherein the toner has an average circularity of 0.960 or more;

a number-average molecular weight Mn(25° C.) of a tetrahydrofuran-soluble matter of the toner is in the range of from 500 to 3000, wherein the tetrahydrofuran-soluble matter is extracted by immersing the toner in 25° C. of tetrahydrofuran, and Mn(25° C.) is measured by size extrusion chromatography with multi-angle laser light scattering photometry (SEC-MALLS); and a value of Mn(135° C.)/Mn(25° C.) is in the range of from 25 to 50, wherein Mn(135° C.) is a number-average molecular weight of an o-dichlorobenzene-soluble matter of the toner, the o-dichlorobenzene-soluble matter is extracted when immersing the toner in Mn(135° C.) of o-dichlorobenzene, and Mn(135° C.) is measured by size extrusion chromatography with multi-angle laser light scattering photometry (SEC-MALLS).

2. The toner according to claim 1, wherein the binder resin is chiefly composed of a resin obtained by polymerization making use of peroxydicarbonate.

3. The toner according to claim 1, wherein the release agent comprises a release agent "a" and a release agent "b"; the release agent "a" being a monofunctional or bifunctional ester wax, and the release agent "b" being a hydrocarbon wax.

4. The toner according to claim 1, wherein the toner base particle have a core/shell structure, and have shell layers each comprising a polyester resin; the polyester resin having a glass transition point (Tg) of 75° C. or more.

5. The toner according to claim 1, wherein, where a tetrahydrofuran-insoluble matter in the binder resin is represented by Gt and an acetone-insoluble matter in the binder resin is represented by Ga, the tetrahydrofuran-insoluble matter Gt is from 5% by mass or more to 40% by mass or less and the value of (Ga−Gt) is from 5% by mass or more to 25% by mass or less.

6. The toner according to claim 1, which has an o-dichlorobenzene-insoluble matter Go (%) at 135° C. in the binder resin, in an amount of 30% by mass or less.

7. The toner according to claim 1, wherein the toner base particle is produced by suspension polymerization.

* * * * *